US011723498B2

(12) United States Patent
Brown et al.

(10) Patent No.: US 11,723,498 B2
(45) Date of Patent: Aug. 15, 2023

(54) VACUUM POD CONFIGURED TO COUPLE TO ONE OR MORE ACCESSORIES

(71) Applicant: SharkNinja Operating, LLC, Needham, MA (US)

(72) Inventors: Andre D. Brown, Natick, MA (US); Jason B. Thorne, Dover, MA (US); Kai Xu, Suzhou (CN); Lee M. Cottrell, Newton, MA (US); Alexander Calvino, Cranston, RI (US); Gordon Howes, Suzhou (CN); AiMing Xu, Suzhou (CN); Wenxiu Gao, Suzhou (CN); Oliver Chambers, London (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/447,734

(22) Filed: Jun. 20, 2019

(65) Prior Publication Data

US 2020/0000298 A1 Jan. 2, 2020

Related U.S. Application Data

(60) Provisional application No. 62/693,282, filed on Jul. 2, 2018.

(51) Int. Cl.

| | |
|---|---|
| ***A47L 5/24*** | (2006.01) |
| ***A47L 9/16*** | (2006.01) |
| ***A47L 9/24*** | (2006.01) |

(52) U.S. Cl.

CPC ..... *A47L 5/24* (2013.01); *A47L 9/1683* (2013.01); *A47L 9/242* (2013.01)

(58) Field of Classification Search

CPC ..... A47L 9/242; A47L 9/0036; A47L 9/0045; A47L 9/248; A47L 9/244; A47L 5/24

(Continued)

(56) References Cited

U.S. PATENT DOCUMENTS

| | | | |
|---|---|---|---|
| 1,983,567 | A | 12/1934 | Replogle et al. |
| 2,677,846 | A | 5/1954 | Segesman |

(Continued)

FOREIGN PATENT DOCUMENTS

| | | |
|---|---|---|
| CN | 2303758 | 1/1999 |
| CN | 2324840 | 6/1999 |

(Continued)

OTHER PUBLICATIONS

PCT Search Report and Written Opinion dated Sep. 10, 2019, received in PCT Application No. PCT/US19/38303, 9 pgs.

(Continued)

*Primary Examiner* — Don M Anderson
*Assistant Examiner* — Sarah Akyaa Fordjour
(74) *Attorney, Agent, or Firm* — Grossman Tucker Perreault & Pfleger, PLLC

(57) ABSTRACT

An example of a vacuum pod may include a handle, a vacuum pod body, a dust cup removably coupled to the vacuum pod body, and a fluid conduit fluidly coupled to the dust cup. The fluid conduit may include a flexible hose configured to transition between an expanded and a retracted position and a coupling configured to be removably coupled to the vacuum pod body. A first end of the flexible hose may be coupled to the vacuum pod body and a second end of the flexible hose may be coupled to the coupling. When the coupling is coupled to the vacuum pod body, the flexible hose may be in the retracted position.

20 Claims, 16 Drawing Sheets

(58) Field of Classification Search
USPC ..... 15/323; 403/109.3; 285/317
See application file for complete search history.

(56) References Cited

U.S. PATENT DOCUMENTS

| | | | | |
|---|---|---|---|---|
| 4,156,952 | A | 6/1979 | Lynch, Jr. | |
| 4,513,472 | A | 4/1985 | Wells | |
| 5,101,615 | A | 4/1992 | Fassauer | |
| 5,331,716 | A | 7/1994 | Hemmann et al. | |
| 5,388,303 | A | 2/1995 | Hemmann et al. | |
| 5,389,004 | A | 2/1995 | Gray et al. | |
| 5,504,970 | A | 4/1996 | Neshat et al. | |
| 5,787,546 | A | 8/1998 | Bass et al. | |
| 5,850,666 | A | 12/1998 | Farone et al. | |
| 6,085,382 | A | 7/2000 | Bobrosky et al. | |
| 6,098,242 | A | 8/2000 | Choi | |
| 6,173,474 | B1 | 1/2001 | Conrad | |
| 6,256,833 | B1 | 7/2001 | Steinberg | |
| 6,260,235 | B1 | 7/2001 | Leung | |
| 6,311,366 | B1 | 11/2001 | Sepke et al. | |
| 6,497,001 | B2 | 12/2002 | Di Nunzio et al. | |
| 6,530,118 | B2 | 3/2003 | Oh | |
| 6,588,051 | B2 | 7/2003 | Hashizume et al. | |
| 7,823,251 | B2 | 11/2010 | Dyson et al. | |
| RE42,155 | E | 2/2011 | Ragner | |
| 8,281,456 | B2 | 10/2012 | Finke | |
| 8,528,160 | B2 | 9/2013 | Conrad | |
| 8,826,490 | B1 | 9/2014 | Giarmo | |
| 8,966,708 | B2 | 3/2015 | Worker et al. | |
| 8,991,005 | B2 | 3/2015 | Mersmann | |
| 9,402,516 | B2 | 8/2016 | Pilch | |
| 9,622,630 | B2 | 4/2017 | Faremo et al. | |
| 10,660,494 | B1 * | 5/2020 | Alton | A47L 9/0081 |
| 2001/0018780 | A1 | 9/2001 | Hashizume et al. | |
| 2002/0101075 | A1 | 8/2002 | Park et al. | |
| 2004/0223803 | A1 | 11/2004 | Fahy et al. | |
| 2005/0155177 | A1 | 7/2005 | Baer et al. | |
| 2007/0040376 | A1 * | 2/2007 | Choi | A47L 9/242 285/275 |
| 2007/0226946 | A1 | 10/2007 | Best | |
| 2008/0086833 | A1 | 4/2008 | Capron-Tee | |
| 2008/0281481 | A1 | 11/2008 | Abramson et al. | |
| 2009/0064449 | A1 | 3/2009 | Newton et al. | |
| 2009/0089969 | A1 | 4/2009 | Lee et al. | |
| 2009/0165242 | A1 | 7/2009 | Lee et al. | |
| 2010/0005614 | A1 | 1/2010 | Cochran et al. | |
| 2011/0088196 | A1 | 4/2011 | Wills et al. | |
| 2011/0088197 | A1 | 4/2011 | Postle et al. | |
| 2011/0088198 | A1 | 4/2011 | Wills et al. | |
| 2011/0088200 | A1 | 4/2011 | White et al. | |
| 2011/0088205 | A1 | 4/2011 | Dyson et al. | |
| 2011/0088206 | A1 | 4/2011 | Ford et al. | |
| 2011/0088208 | A1 | 4/2011 | White et al. | |
| 2011/0088212 | A1 | 4/2011 | Dyson et al. | |
| 2011/0094054 | A1 | 4/2011 | Dos Reis et al. | |
| 2011/0219569 | A1 | 9/2011 | Vines et al. | |
| 2011/0219581 | A1 | 9/2011 | Vines et al. | |
| 2012/0030900 | A1 | 2/2012 | Seo et al. | |
| 2012/0180258 | A1 | 7/2012 | Seo | |
| 2012/0222250 | A1 * | 9/2012 | Conrad | A47L 9/1691 15/347 |
| 2012/0222251 | A1 * | 9/2012 | Conrad | A47L 9/322 15/347 |
| 2012/0233806 | A1 | 9/2012 | Streciwilk | |
| 2013/0081226 | A1 * | 4/2013 | Mcluckie | A47L 5/32 15/414 |
| 2013/0086770 | A1 | 4/2013 | Wolfe, Jr. | |
| 2013/0091813 | A1 | 4/2013 | Smith | |
| 2014/0033471 | A1 | 2/2014 | Toole et al. | |
| 2014/0245562 | A1 * | 9/2014 | Conrad | A47L 9/2868 15/323 |
| 2014/0338148 | A1 * | 11/2014 | Lee | A47L 9/0673 15/400 |
| 2016/0128527 | A1 | 5/2016 | Grey et al. | |
| 2016/0198914 | A1 | 7/2016 | Conrad | |
| 2016/0208981 | A1 | 7/2016 | Kaesemeyer | |
| 2016/0213218 | A1 | 7/2016 | Ham et al. | |
| 2016/0270614 | A1 | 9/2016 | Kawamura et al. | |
| 2016/0270615 | A1 | 9/2016 | Kawamura et al. | |
| 2017/0265697 | A1 | 9/2017 | Conrad | |
| 2017/0340177 | A1 | 11/2017 | Conrad | |
| 2018/0064301 | A1 * | 3/2018 | Cottrell | A47L 9/32 |
| 2018/0132683 | A1 * | 5/2018 | Walker | A47L 9/0036 |

FOREIGN PATENT DOCUMENTS

| | | |
|---|---|---|
| CN | 1889877 | 1/2007 |
| CN | 101116770 | 2/2008 |
| CN | 100539920 | 9/2009 |
| CN | 101828891 | 9/2010 |
| CN | 201631106 | 11/2010 |
| CN | 104271020 | 1/2015 |
| CN | 105832247 | 8/2016 |
| CN | 205458447 | 8/2016 |
| DE | 3834686 | 12/1989 |
| DE | 202008017137 | 3/2009 |
| DE | 102011001631 | 10/2011 |
| DE | 102012110182 | 4/2014 |
| EP | 0983741 | 3/2000 |
| EP | 1356755 | 10/2003 |
| EP | 1591052 | 11/2005 |
| EP | 1758493 | 3/2007 |
| EP | 2055219 | 5/2009 |
| GB | 2290462 | 1/1996 |
| GB | 2304549 | 3/1997 |
| JP | S60194919 | 10/1985 |
| JP | S61012461 | 1/1986 |
| JP | S62151835 | 9/1987 |
| JP | 63194615 | 8/1988 |
| JP | H02172427 | 7/1990 |
| JP | H02234733 | 9/1990 |
| JP | H033956 | 1/1991 |
| JP | H034825 | 1/1991 |
| JP | H05184502 | 7/1993 |
| JP | H07322972 | 12/1995 |
| JP | 2000116574 | 4/2000 |
| JP | 4258730 | 4/2009 |
| JP | 2010194070 A | 9/2010 |
| JP | 2013162882 A | 8/2013 |
| KR | 100774508 | 11/2007 |
| KR | 101003601 | 12/2010 |
| KR | 101052161 | 7/2011 |
| KR | 20120004104 | 1/2012 |
| KR | 20120014326 | 2/2012 |
| KR | 20120016810 | 2/2012 |
| WO | 2005034706 | 4/2005 |
| WO | 2008142642 | 11/2008 |
| WO | 2009030885 | 3/2009 |
| WO | 2013139364 | 9/2013 |

OTHER PUBLICATIONS

PCT Search Report and Written Opinion dated Nov. 25, 2019, received in PCT Application No. PCT/US19/49925, 10 pgs.
PCT Search Report and Written Opinion dated Apr. 26, 2019, received in PCT Application No. PCT/US19/17030, 9 pgs.
Chinese Office Action with English translation dated Nov. 15, 2021, received in Chinese Patent Application No. 201980070915.0, 13 pages.
U.S. Office Action dated Dec. 8, 2021, received in U.S. Appl. No. 16/562,989, 24 pages.
Chinese Office Action with English translation dated Aug. 24, 2021, received in Chinese Patent Application No. 201980049043.X, 10 pages.
U.S. Office Action dated Jun. 30, 2021, received in U.S. Appl. No. 16/562,989, 16 pages.
UK Examination Report dated Feb. 17, 2022, received in UK Patent Application No. GB2020866.6, 6 pages.
U.S. Office Action dated Jun. 1, 2022, received in U.S. Appl. No. 16/562,989, 18 pages.

(56) References Cited

OTHER PUBLICATIONS

Chinese Office Action with machine generated translation, dated Aug. 2, 2022, received in Chinese Patent Application No. 201980070915.0, 21 pages.
U.S. Office Action dated Jan. 23, 2023, received in U.S. Appl. No. 16/562,989, 18 pages.
Chinese Office Action with English translation dated Feb. 27, 2023, received in Chinese Patent Application No. 2019800709150, 10 pages.

* cited by examiner

VACUUM POD CONFIGURED TO COUPLE TO ONE OR MORE ACCESSORIES

CROSS-REFERENCE TO RELATED APPLICATIONS

The present application claims the benefit of U.S. Provisional Application Ser. No. 62/693,282 filed on Jul. 2, 2018, entitled Vacuum Pod Configured to Couple to one or more Accessories, which is fully incorporated herein by reference.

TECHNICAL FIELD

The present disclosure is generally directed to surface treatment apparatuses and more specifically to a vacuum pod configured to couple to one or more accessories.

BACKGROUND INFORMATION

Surface treatment apparatuses may include vacuum cleaners configured to suction debris from a surface (e.g., a floor). The vacuum cleaner may include a surface treatment head having one or more brush rolls configured to agitate a surface (e.g., a carpet) to urge debris into an airflow stream generated by the vacuum cleaner. The debris within the airflow stream may then be deposited in a debris collector (e.g., a bag) for later disposal.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a surface treatment apparatus having a vacuum pod configured to be fluidly coupled to one or more surface treatment accessories (e.g., a surface treatment head, a wand, a brush, and/or any other accessory). The vacuum pod includes a vacuum pod body, a dust cup, and a fluid conduit fluidly coupled to the dust cup. The fluid conduit includes a flexible hose and a coupling configured to removably couple to the vacuum pod body. The flexible hose is configured to transition between an expanded and a retracted position, wherein, when the coupling is coupled to the vacuum pod body, the flexible hose is in the retracted position. In some instances, the dust cup can include a protrusion configured to mitigate and/or prevent debris deposited within the dust cup from being entrained in air flowing through the dust cup.

As generally referred to herein, the term resiliently deformable may refer to an ability of a mechanical component to repeatably transition between an un-deformed and a deformed state (e.g., transition between the un-deformed and deformed state at least 100 times, 1,000 times, 100,000 times, 1,000,000 times, 10,000,000 times, or any other suitable number of times) without the component experiencing a mechanical failure (e.g., the component is no longer able to function as intended).

Figure 1:
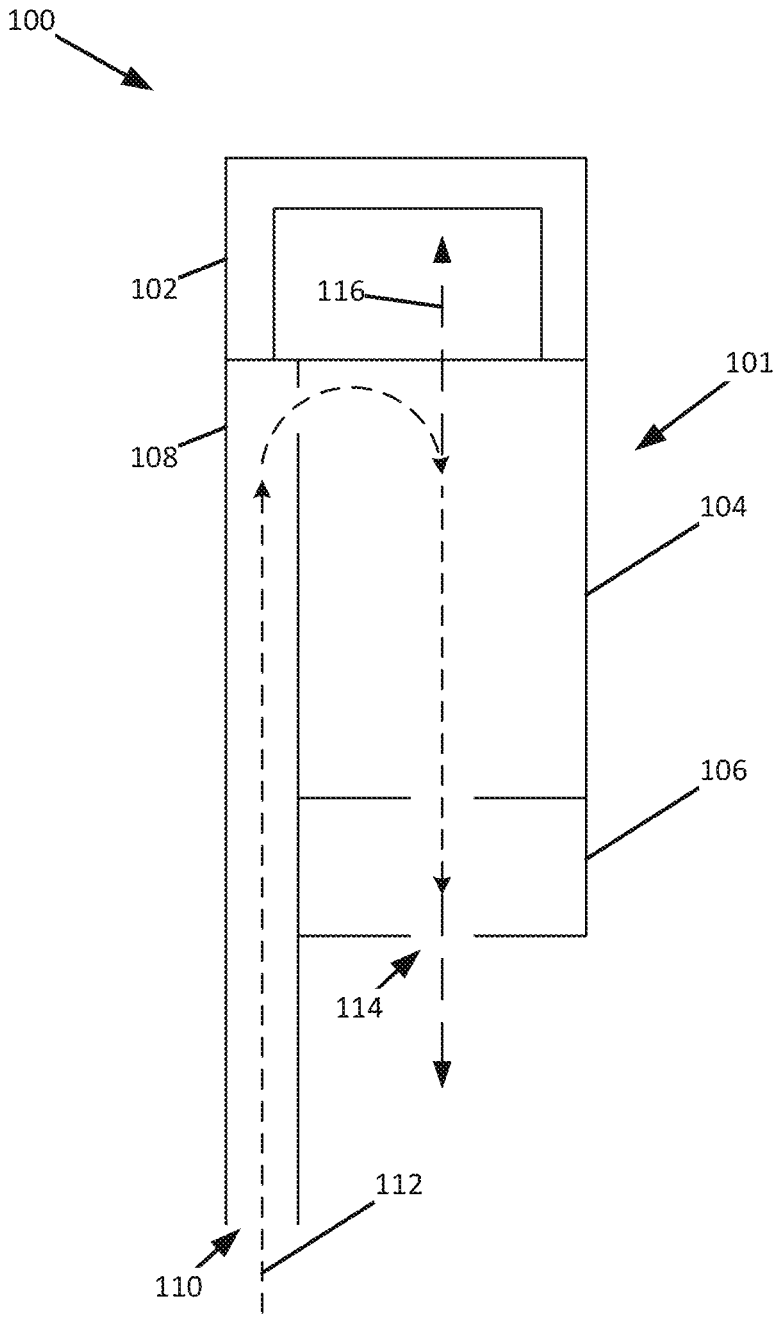
FIG. 1 shows a schematic cross-sectional view of a vacuum pod, consistent with embodiments of the present disclosure.

FIG. 1 shows a schematic cross-sectional view of a vacuum pod 100 having a handle 102, a dust cup 104, a suction motor 106, and a fluid conduit 108. The fluid conduit 108 includes an air inlet 110 fluidly coupled to the dust cup 104 such that, when the suction motor 106 is activated, fluid (e.g., air) flows along a flow path 112 extends from the air inlet 110 through the dust cup 104 and suction motor 106 and exits the vacuum pod 100 at an outlet 114.

As shown, at least a portion of the dust cup 104 is disposed between the handle 102 and the suction motor 106. This positions the handle 102 and the suction motor 106 at opposing end regions of the vacuum pod 100 (e.g., on opposing sides of a central plane extending through the center of the vacuum pod 100, wherein the central plane extends perpendicular to a longitudinal axis of the vacuum pod 100). The dust cup 104 and the suction motor 106 are disposed along an axis 116. The axis 116 may be a central axis of the dust cup 104. Additionally, or alternatively, a center of mass of the suction motor 106 may be generally aligned with the axis 116. The suction motor 106 may have any orientation relative to the axis 116.

The fluid conduit 108 may include a flexible and/or expandable (e.g., longitudinally) hose. In these instances, the fluid conduit 108 can be configured to include a portion that is removably coupled to the vacuum pod 100 such that a portion of the fluid conduit 108 can be maneuvered independently of, for example, the dust cup 104 and the suction motor 106. As a result, a user can carry a vacuum pod body 101 (e.g., the portion of vacuum pod 100 housing at least the dust cup 104 and the suction motor 106) of the vacuum pod 100 in one hand while maneuvering the fluid conduit 108 with the other.

Figure 2:
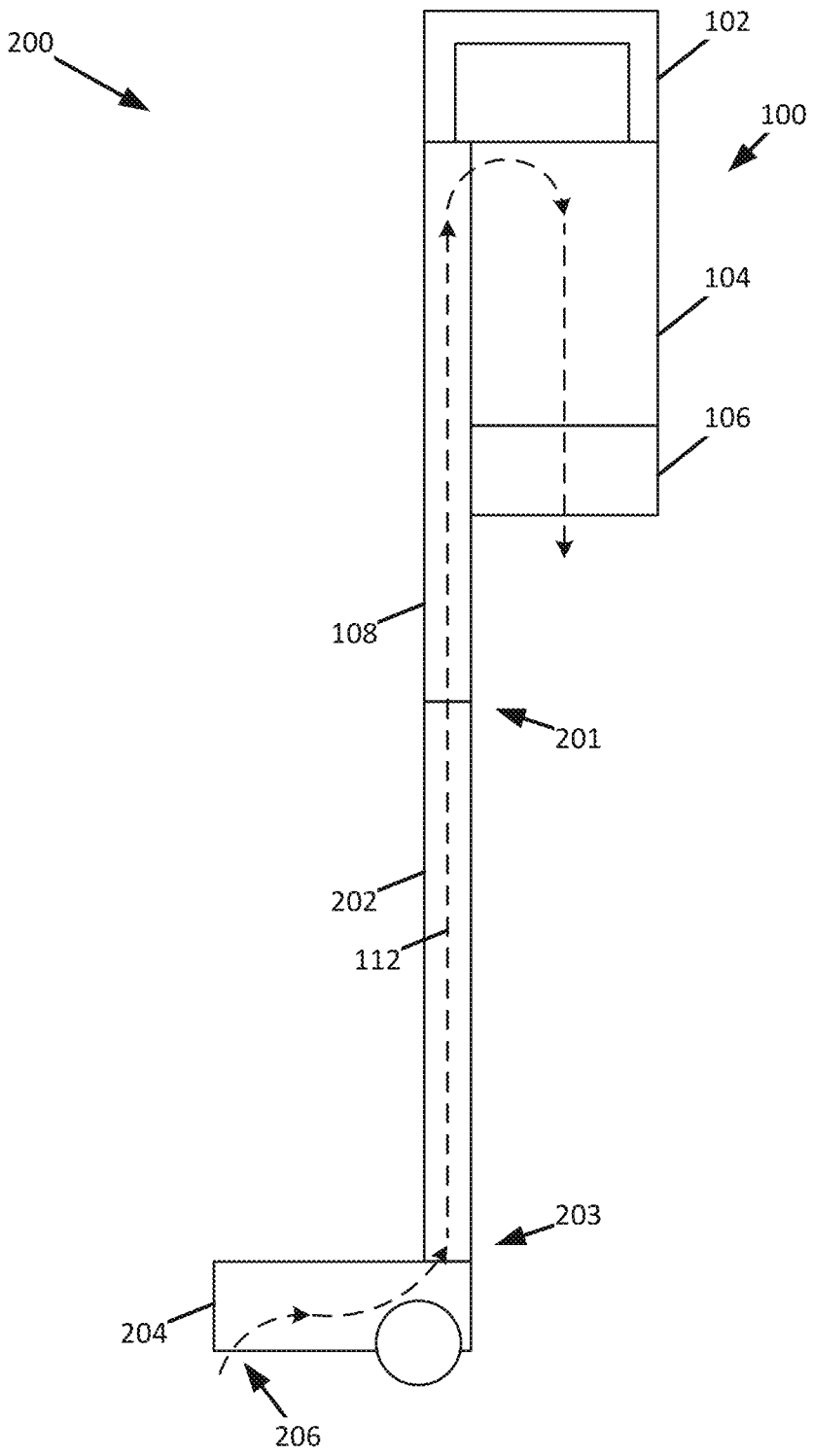
FIG. 2 shows a schematic view of a surface treatment apparatus having the vacuum pod of FIG. 1 coupled thereto, consistent with embodiments of the present disclosure.

FIG. 2 shows a schematic view of a surface treatment apparatus 200 having the vacuum pod 100 fluidly coupled to a first end 201 of a wand 202 and a surface treatment head 204 coupled to a second end 203 of the wand 202, wherein the first end 201 is opposite the second end 203. As shown, the vacuum pod 100 is positioned proximate to the first end 201 of the wand 202.

The dust cup 104 and the suction motor 106 can be disposed between the handle 102 and the surface treatment head 204 such that the surface treatment head 204 is disposed closer to the suction motor 106 than the handle 102. Such a configuration positions the center of mass of the vacuum pod 100 at a position closer to the surface treatment head 204 when compared to a configuration having, for example, the suction motor 106 disposed between the dust cup 104 and the handle 102. As a result, the surface treatment apparatus 200 may feel lighter to a user.

As shown, when the suction motor 106 is activated, the flow path 112 extends from a surface treatment head inlet 206 through the wand 202 and the fluid conduit 108 into the dust cup 104 through the suction motor 106 and exits the vacuum pod 100. As such, the vacuum pod 100 can generally be described as being fluidly coupled to the surface treatment head 204 and the wand 202. In some instances, the wand 202 and the fluid conduit 108 may be electrified such that the suction motor 106 and electric components of the surface treatment head 204 (e.g., a brush roll motor, a light source, and/or any other electric component) can be powered from a common source (e.g., a battery and/or an electrical power grid).

Figure 3:
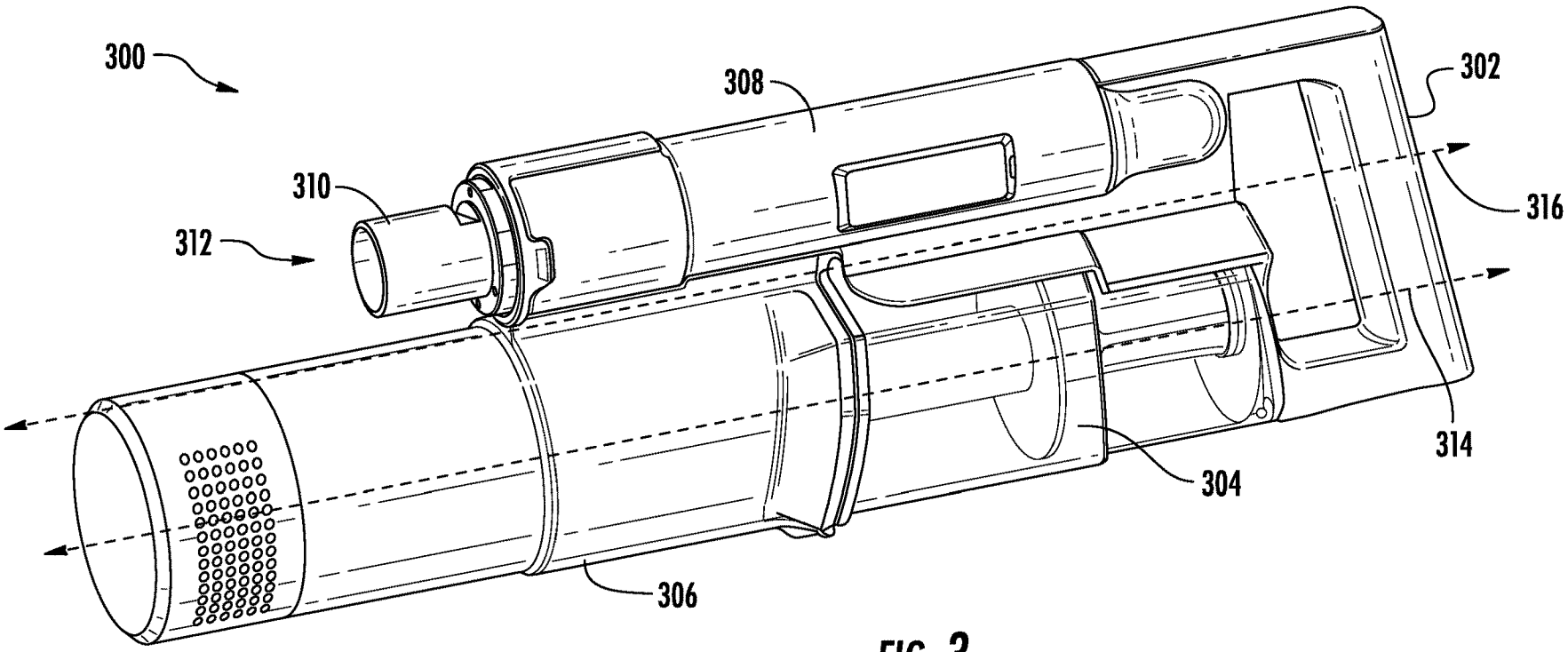
FIG. 3 shows a perspective view of a vacuum pod, consistent with embodiments of the present disclosure.

FIG. 3 shows a perspective view of a vacuum pod 300, which may be an example of the vacuum pod 100 of FIG. 1. As shown, the vacuum pod 300 includes a handle 302, a dust cup 304, a suction motor assembly 306, and a fluid conduit 308. As also shown, a coupling 310 that defines a fluid inlet 312 is provided at an end of the fluid conduit 308. The coupling 310 may be configured to fluidly couple to one or more surface treatment accessories.

The dust cup 304 may be positioned along an axis 314 (e.g., an axis of the dust cup 304 and/or the suction motor assembly 306) and between the handle 302 and the suction motor assembly 306. The axis 314 extends generally parallel to a longitudinal axis 316 of the vacuum pod 300 and/or generally parallel to the fluid conduit 308. As shown, the axis 314 extends through both the suction motor assembly 306 and the dust cup 304. Therefore, the dust cup 304 and the suction motor assembly 306 may generally be described as being in an in-line (or a series) configuration. In some instances, the axis 314 may be a central axis of the dust cup 304. Additionally, or alternatively, the center of mass of the suction motor assembly 306 may be generally aligned with the axis 314.

Figure 4:
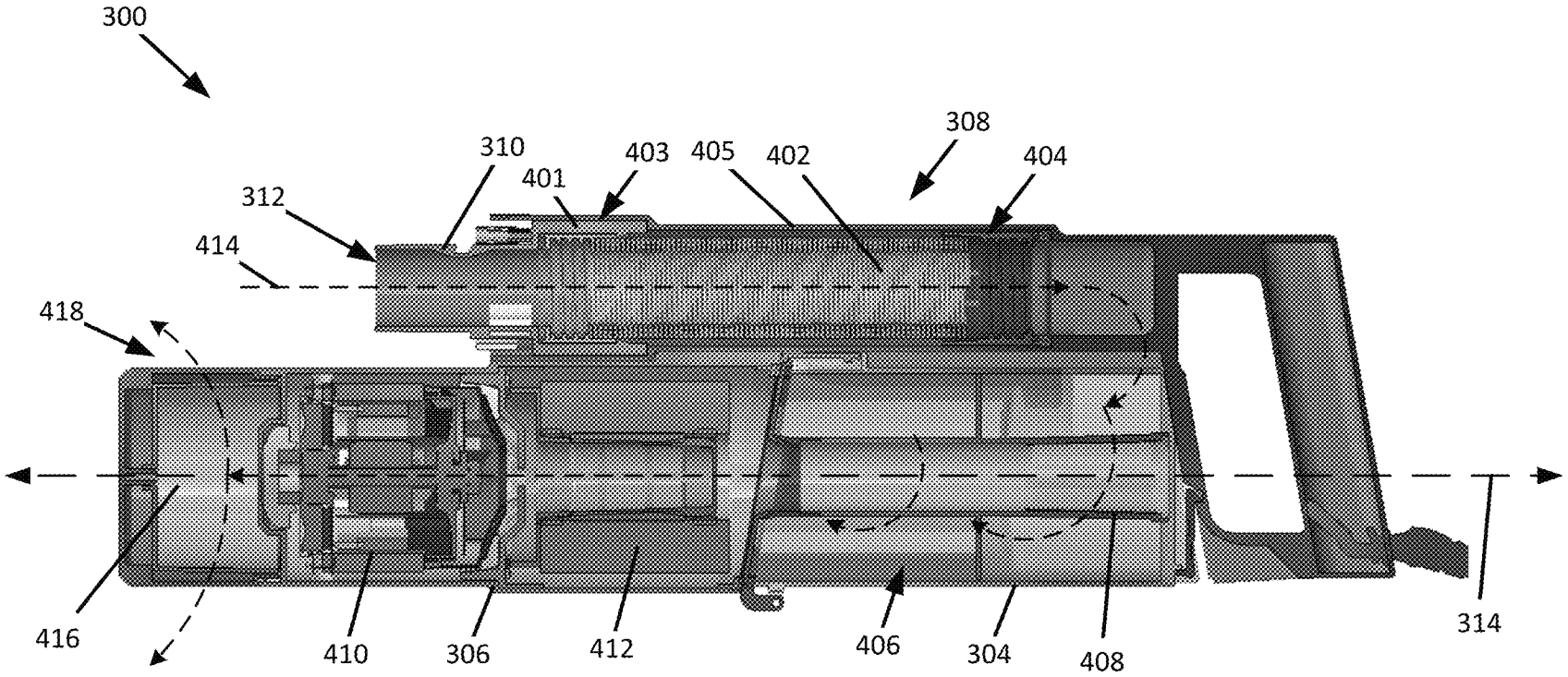
FIG. 4 shows a cross-sectional view of the vacuum pod of FIG. 3, consistent with embodiments of the present disclosure.
Figure 5:
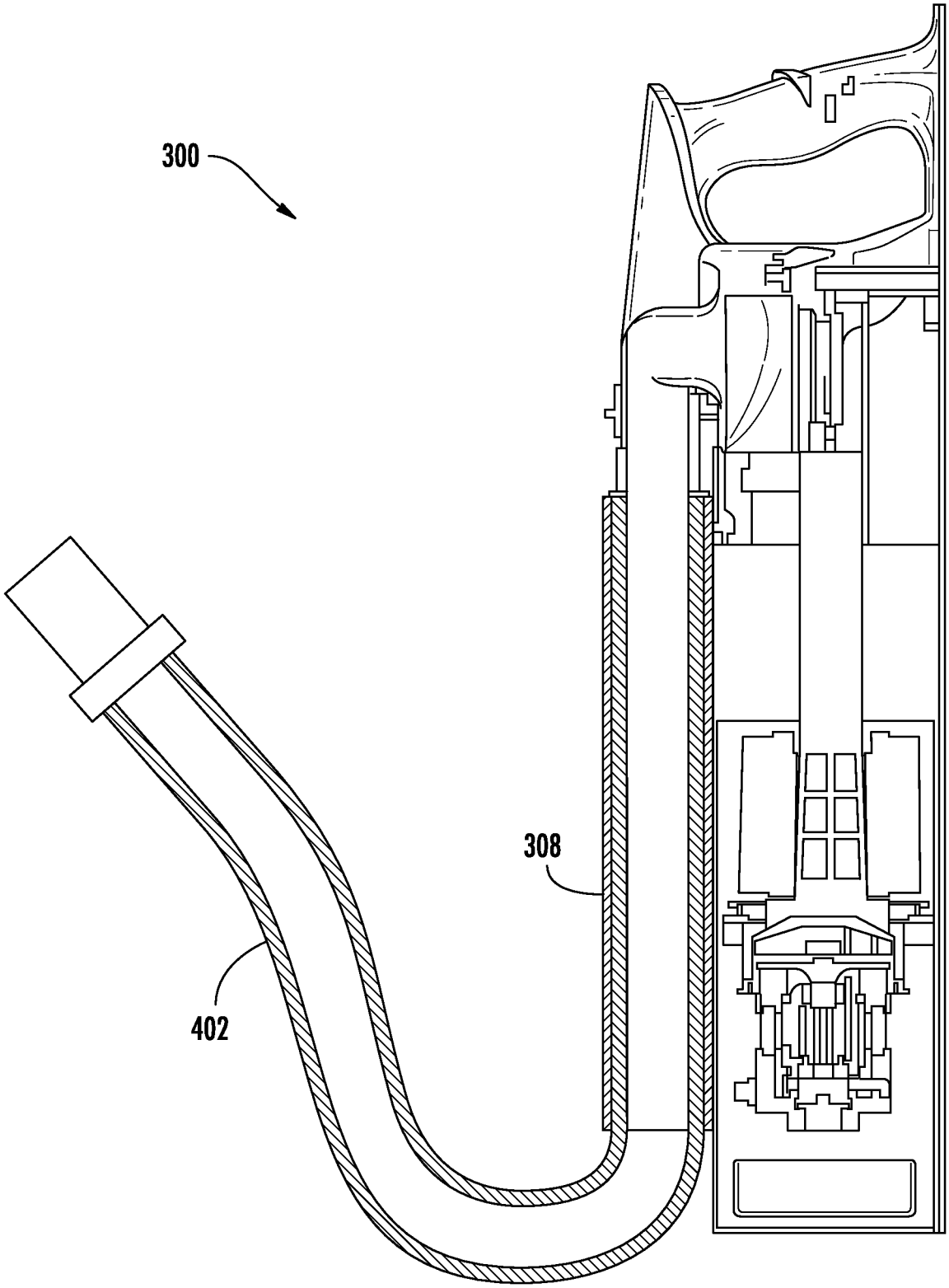
FIG. 5 shows another cross-sectional view of the vacuum pod of FIG. 3, consistent with embodiments of the present disclosure.

FIG. 4 shows a cross-sectional view of the vacuum pod 300 of FIG. 3. As shown, a flexible hose 402 extends within a cavity 404 defined by a conduit body 405 of the fluid conduit 308. As such, the fluid conduit 308 may generally be described as including the flexible hose 402. The flexible hose 402 is expandable such that the flexible hose 402 is capable of extending from the cavity 404. As such, the flexible hose 402 may generally be described as being configured to be stored within the cavity 404. In other words, the flexible hose 402 may generally be described as being configured to transition between an extended/expanded position (as shown in FIG. 5) and a retracted position (as shown in FIG. 4). In some instances, the flexible hose 402 may have sufficient elasticity to urge to flexible hose 402 in a direction of the retracted position.

The flexible hose 402 is coupled to the coupling 310. The coupling 310 can include an engaging portion 401 configured to engage a surface 403 of the cavity 404 such that the flexible hose 402 can be retained in a retracted position (e.g., such that the flexible hose 402 is stored within the cavity 404). For example, the engaging portion 401 may form a friction fit with the surface 403, the engaging portion 401 and/or the surface 403 may include one or more detents, and/or any other retaining mechanism.

As shown, the dust cup 304 includes a debris cavity 406. The dust cup 304 may be configured to cause a cyclone to be generated. For example, the dust cup 304 may include at least one vortex finder 408 and/or a tangential inlet such that at least one cyclone can be generated within the dust cup 304. In some instances, the cyclone extends generally parallel to, for example, the fluid conduit 308 and/or the axis 314. As also shown, the suction motor assembly 306 includes a suction motor 410 and a premotor filter 412. In some instances, and as shown, a central axis of the suction motor 410 (e.g., a rotation axis of an impeller) and a longitudinal axis of the vortex finder 408 and/or dust cup 304 (e.g., a central axis of the vortex finder 408 and/or dust cup 304) may extend along the axis 314.

When the suction motor 410 is activated fluid is caused to flow along a flow path 414. The flow path 414 extends from the fluid inlet 312 of the coupling 310 through the flexible hose 402 into the dust cup 304 through the premotor filter 412 into the suction motor 410 through a post motor filter 416 and out an exhaust outlet 418.

Figure 6:
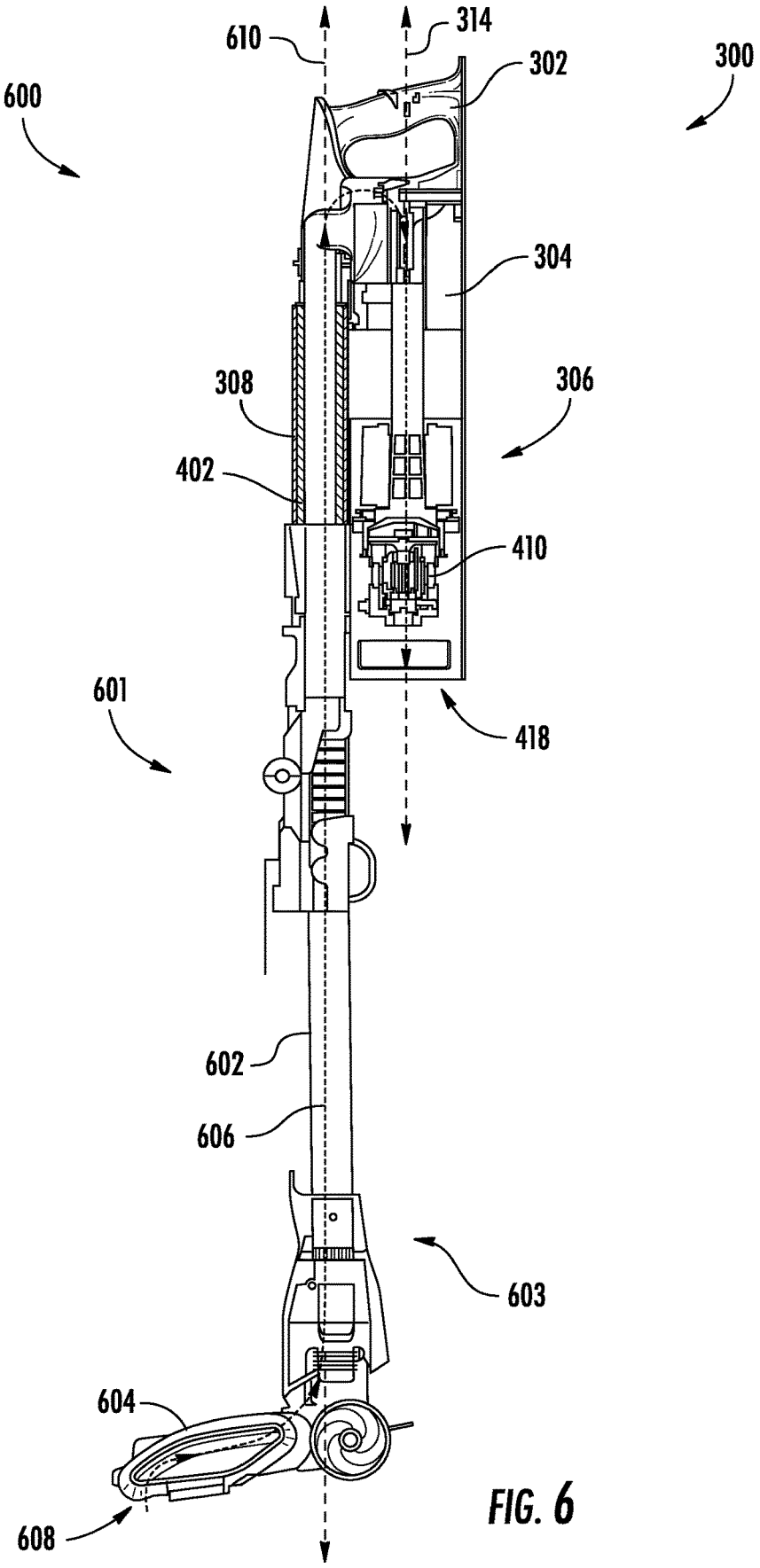
FIG. 6 shows a partial cross-sectional view of a surface treatment apparatus including the vacuum pod of FIG. 3, consistent with embodiments of the present disclosure.

FIG. 6 shows a partial cross-sectional view of an example of a surface treatment apparatus 600 having the vacuum pod 300 of FIG. 3 fluidly coupled to a first end 601 of a wand 602 (e.g., using the flexible hose 402) and a surface treatment head 604 coupled to a second end 603 of the wand 602, wherein the first end 601 is opposite the second end 603. As shown, the vacuum pod 300 is positioned proximate to the first end 601 of the wand 602.

As also shown, the dust cup 304 and the suction motor 410 are disposed between the handle 302 and the surface treatment head 604 such that the surface treatment head 604 is disposed closer to the suction motor 410 than the handle 302. Such a configuration positions the center of mass of the vacuum pod 300 at a location closer to the surface treatment head 604 when compared to a configuration having, for example, the suction motor 410 disposed between the handle 302 and the dust cup 304. As a result, the surface treatment apparatus 600 may feel lighter to a user.

When the suction motor 410 is activated a fluid is caused to flow along a flow path 606. The flow path 606 extends from an inlet 608 of the surface treatment head 604 along a channel defined in the wand 602 through the fluid conduit 308 into the dust cup 304 and the suction motor 410 and out of the exhaust outlet 418. In some instances, the wand 602 and/or the fluid conduit 308 (e.g., the flexible hose 402) can be electrified such that the suction motor 410 and electronic components of the surface treatment head 604 (e.g., a brush motor, a light source, and/or any other electric component) can be powered from a common source (e.g., a battery and/or an electrical power grid).

Figure 7:
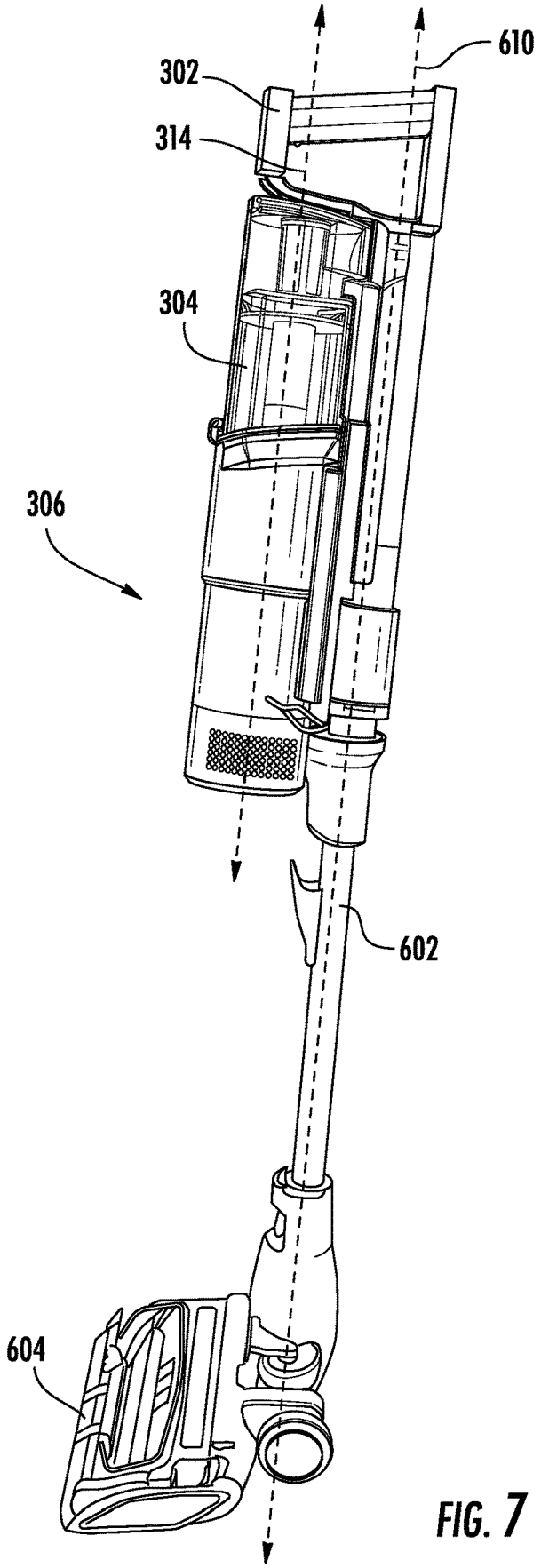
FIG. 7 shows a perspective view of the surface treatment apparatus of FIG. 6, consistent with embodiments of the present disclosure.

As shown, the suction motor assembly 306 and the dust cup 304 can extend under the handle 302 along the axis 314 in a direction of the surface treatment head 604. The axis 314 can be spaced apart from and generally parallel to a longitudinal axis 610 of the wand 602. For example, and as shown, the axis 314 can be spaced apart from the longitudinal axis 610 of the wand 602 in a direction such that the suction motor assembly 306 and the dust cup 304 are positioned on a user facing side of the surface treatment apparatus 600. By way of further example, and as shown in FIG. 7, the axis 314 can be spaced apart from the longitudinal axis 610 of the wand 602 in a direction such that the suction motor assembly 306 and the dust cup 304 are positioned over the surface treatment head 604 (e.g., opposite the user facing side of the surface treatment apparatus 600).

As also shown, the longitudinal axis 610 of the wand 602 aligns with the longitudinal axis of the fluid conduit 308 when the vacuum pod 300 is coupled to the wand 602 of the surface treatment apparatus 600. In other words, the wand 602 and the fluid conduit 308 may generally be described as being axially aligned along the longitudinal axis 610 of the wand 602 when the vacuum pod 300 is coupled to the wand 602 of the surface treatment apparatus 600.

Figure 9:
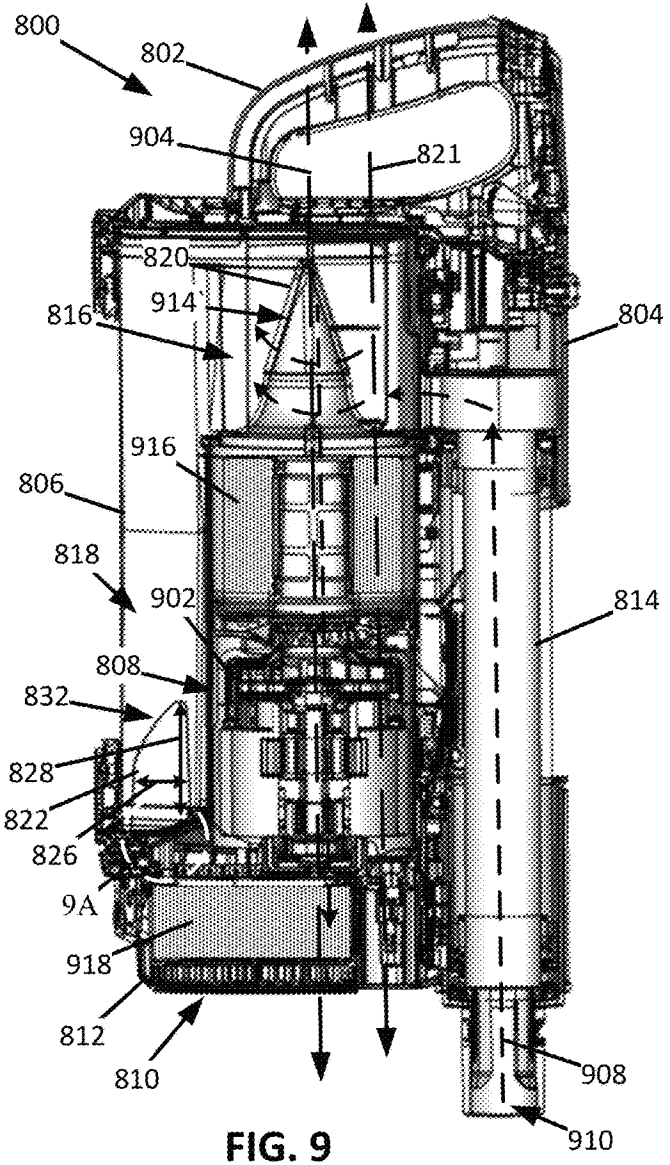
FIG. 9 shows a cross-sectional view of the vacuum pod of FIG. 8 taken along the line IX-IX, consistent with embodiments of the present disclosure.
Figure 8:
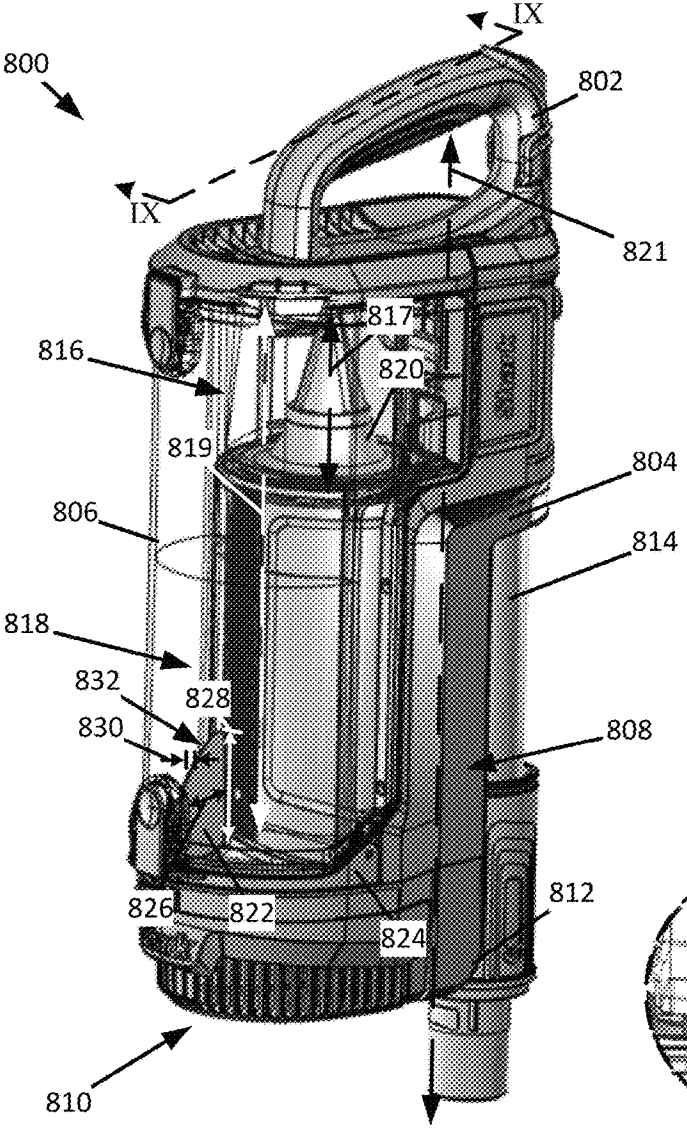
FIG. 8 shows a perspective view of a vacuum pod, consistent with embodiments of the present disclosure.

FIG. 8 shows a perspective view of a vacuum pod 800 and FIG. 9 shows a cross-sectional perspective view of the vacuum pod 800 taken along the line IX-IX of FIG. 8. The vacuum pod 800 may be an example of the vacuum pod 100 of FIG. 1. The vacuum pod 800 includes a handle 802 and a vacuum pod body 804. The vacuum pod body 804 defines a receptacle configured to receive a dust cup 806 such that the dust cup 806 can be removably coupled to the vacuum pod body 804, a suction motor cavity 808 for receiving a suction motor 902, and a post motor filter cavity 810 having a removable panel 812. A fluid conduit 814 is coupled to the vacuum pod body 804 and is fluidly coupled to the dust cup 806.

The dust cup 806 can include a cyclonic region 816 and a debris collection region 818. As shown, a cyclonic region central axis 817 and a debris collection region central axis 819 can be horizontally spaced apart and each can extend generally parallel to a longitudinal axis 821 of the vacuum pod 800. As such, the dust cup 806 can generally be described as having a first portion (e.g., that includes the debris collection region 818) that extends longitudinally along the vacuum pod body 804 and a second portion (e.g., that includes the cyclonic region 816) that extends transverse to the longitudinal axis 821 of the vacuum pod 800. The cyclonic region 816 can be configured to cause air flowing therein to move cyclonically. The cyclonic region 816 can include a vortex finder 820 about which air moving through the dust cup 806 cyclonically extends. The cyclonic motion of air about the vortex finder 820 can cause at least a portion of debris entrained within the air to fall out of the air and be deposited in the debris collection region 818.

Figure 9A:
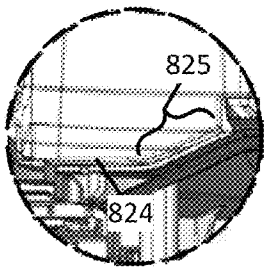
FIG. 9A shows a magnified view corresponding to region 9A of FIG. 9, consistent with embodiments of the present disclosure.

In operation, a portion of the debris stored within the debris collection region 818 may become re-entrained within air flowing through the dust cup 806. As such, the debris collection region 818 may include a protrusion 822 that is configured to mitigate/discourage or prevent entrainment of debris deposited in the debris collection region 818 within air flowing through the dust cup 806. The protrusion 822 can extend from a distal end of the debris collection region 818. For example, the protrusion 822 may extend from an openable door 824 of the dust cup 806, wherein the openable door 824 is configured to transition between a closed position and an open position in order to empty the dust cup 806 when the dust cup 806 is decoupled from the vacuum pod body 804. The openable door 824 can be pivotally coupled to a distal end of the dust cup 806 such that the openable door 824 is spaced apart from the cyclonic region 816. As shown in FIG. 9A, which shows a magnified view corresponding to region 9A of FIG. 9, the openable door 824 includes a sloped portion 825 that extends towards the vacuum pod body 804 in a direction of the cyclonic region 816 and from which at least a portion of the protrusion 822 can extend.

As shown, a protrusion width 826 may measure less than a protrusion height 828 and a protrusion thickness 830 may measure less than the protrusion width 826 and the protrusion height 828. As such, the protrusion may generally be described as forming a fin. As also shown, the protrusion 822 may include a chamfered region 832. The chamfered region 832 may be spaced apart from the openable door 824 and extend along a distal end of the protrusion 822 in a direction of the vacuum pod body 804.

As also shown, the dust cup 806 is coupled to the vacuum pod body 804 such that at least a portion of the dust cup 806 extends between the handle 802 and the suction motor cavity 808. For example, at least a portion of the cyclonic region 816 may be disposed between the handle 802 and the suction motor cavity 808. In these instances, and as shown, for example, in FIG. 9, the suction motor cavity 808 can be configured such that the suction motor 902 and the vortex finder 820 are aligned along an axis 904 extending parallel to the longitudinal axis 821 of the vacuum pod 800. Such a configuration, may allow an air path 908 extending from the vortex finder 820 and through suction motor 902 to be generally linear.

For example, and as shown in FIG. 9, the air path 908 extends from an inlet 910 of the fluid conduit 814 through the fluid conduit and into the dust cup 806. Once in the dust cup 806, the air path 908 extends cyclonically around the vortex finder 820 and exits the dust cup 806 through a passageway 914 defined in the vortex finder 820. Upon entering the passageway 914, the air path 908 extends generally linearly through a premotor filter 916, the suction motor 902, and a post motor filter 918.

Figures 10, 10A, 10B:
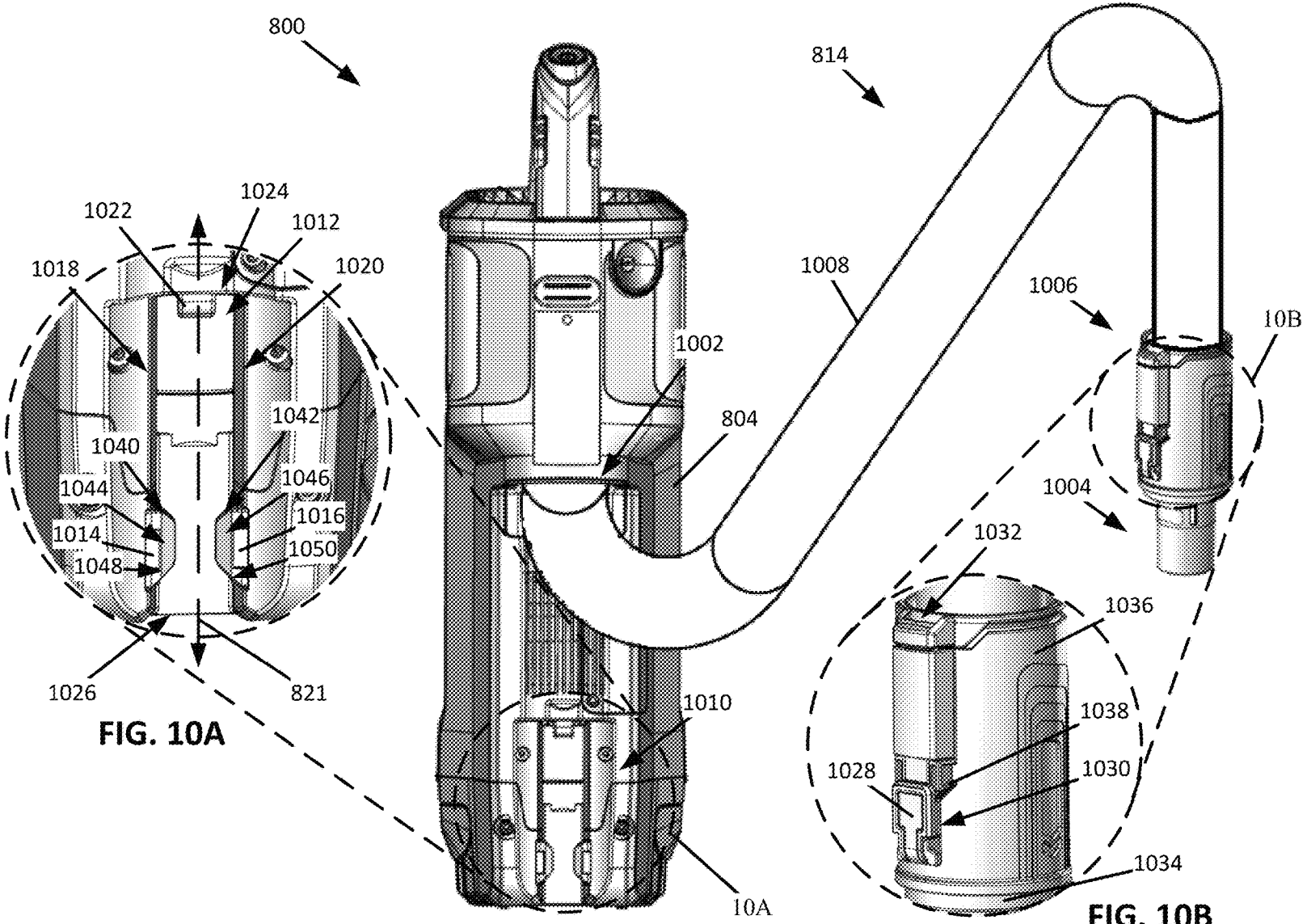
FIG. 10 shows a perspective rear-view of the vacuum pod of FIG. 8, consistent with embodiments of the present disclosure.
FIG. 10A shows a magnified perspective view corresponding to region 10A of FIG. 10, consistent with embodiments of the present disclosure.
FIG. 10B shows a magnified perspective view corresponding to region 10B of FIG. 10, consistent with embodiments of the present disclosure.

FIG. 10 is a perspective view of the vacuum pod 800, wherein FIGS. 10A and 10B correspond to magnified perspective views of regions 10A and 10B of FIG. 10, respectively. As shown, a first end 1002 of the fluid conduit 814 is coupled to the vacuum pod body 804 and a second end 1004 of the fluid conduit 814 includes a coupling 1006. The coupling 1006 can be configured to removably couple to at least a portion of the vacuum pod body 804 such that the fluid conduit 814 can be moved independently of the vacuum pod body 804. In some instances, at least a portion of the fluid conduit 814 can be resiliently deformable such that the fluid conduit 814 can be moved independently of the vacuum pod body 804. For example, the fluid conduit 814 can include a flexible hose 1008 extending between the coupling 1006 and the vacuum pod body 804. As shown, a first end of the flexible hose 1008 is coupled to the vacuum pod body 804 and a second end of the flexible hose 1008 is coupled to the coupling 1006.

The flexible hose 1008 can be configured to transition between an extended/expanded position and a retracted position. When the flexible hose 1008 is in the extended position, the coupling 1006 can be decoupled from the vacuum pod body 804 and a length of the flexible hose 1008 measures greater than a length of the flexible hose 1008 in the retracted position. When in the retracted position, the coupling 1006 can be coupled to the vacuum pod body 804 and an overall length of the flexible hose 1008 may measure less than a longitudinal length of the vacuum pod 800. As such, when the coupling 1006 is coupled to the vacuum pod body 804, the flexible hose 1008 may not extend beyond the vacuum pod body 804 in a longitudinal direction.

The vacuum pod body 804 can include a receptacle 1010 configured to receive at least a portion of the coupling 1006. As shown, the receptacle 1010 defines a channel 1012 that extends in a direction generally parallel to the longitudinal axis 821 of the vacuum pod 800. The channel 1012 includes first and second retention arms 1014 and 1016 disposed on opposing longitudinal sidewalls 1018 and 1020 of the channel 1012 and a retention hook 1022 on a distal end wall 1024 of the channel 1012. The channel 1012 can include an open end 1026 that is opposite the distal end wall 1024. The channel 1012 and the open end 1026 can be configured to receive at least a portion of the coupling 1006.

The retention arms 1014 and 1016 can be biased inwardly into the channel 1012 (e.g., using a biasing mechanism such as a spring). As such, when at least a portion of the coupling 1006 is received within the channel 1012, the retention arms 1014 and 1016 can generally be described as being urged into engagement with the coupling 1006. The retention hook 1022 can be biased inwardly into the channel 1012 in a direction generally parallel to the longitudinal axis 821 of the vacuum pod 800 (e.g., using a biasing mechanism such as a spring). As such, when at least a portion of the coupling 1006 is received within the channel 1012, the retention hook 1022 can generally be described as being urged into engagement with the coupling 1006.

The coupling 1006 can include a catch 1028, wherein at least a portion of the catch 1028 is configured to be received within the channel 1012. For example, the catch 1028 can be configured to engage the first and second retention arms 1014 and 1016. When the coupling 1006 is urged into engagement with the receptacle 1010 such that the coupling 1006 can be coupled to the vacuum pod body 804, the catch 1028 can be configured to urge the retention arms 1014 and 1016 outwardly. For example, and as shown, the catch 1028 can include a plurality of grooves 1030 defined on opposing sides of the catch 1028 and the catch 1028 can be configured to urge the retention arms 1014 and 1016 outwardly until at least a portion of the retention arms 1014 and 1016 can engage corresponding grooves 1030. When at least a portion of the retention arms 1014 and 1016 are aligned with corresponding grooves 1030, the retention arms 1014 and 1016 are urged into the corresponding groves 1030 as a result of being biased inwardly. As such, the retention arms 1014 and 1016 can generally be described as being urged into corresponding grooves 1030 when the coupling 1006 is coupled to the receptacle 1010.

The coupling 1006 can also include a retention cavity 1032 configured to receive at least a portion of the retention hook 1022. When the coupling 1006 is urged into engagement with the receptacle 1010, a portion of the coupling 1006 can be configured to urge the retention hook 1022 outwardly from the channel 1012 until the retention hook 1022 can be received within the retention cavity 1032. As such, the retention hook 1022 can generally be described as being urged into the retention cavity 1032 when the coupling 1006 is coupled to the receptacle 1010.

As shown, the retention arms 1014 and 1016 can include first retaining bevels 1044 and 1046 and second retaining bevels 1048 and 1050. The surfaces defining the first retaining bevels 1044 and 1046 extend transverse (e.g., perpendicular) to surfaces defining the second retaining bevels 1048 and 1050. A portion of the catch 1028 can be configured to engage one or more of the first and/or second retaining bevels 1044, 1046, 1048, and/or 1050 when the coupling 1006 is being coupled to the receptacle 1010 such that the retention arms 1014 and 1016 are urged outwardly. As such, the coupling 1006 can be coupled to the receptacle 1010 in response to being inserted into the channel 1012 in a direction transverse to and/or generally parallel to the longitudinal axis 821 of the vacuum pod 800. In other words, the first and/or second retaining bevels 1044, 1046, 1048, and/or 1050 can be configured to cooperate with at least a portion of the coupling 1006 to urge the retention arms 1014 and 1016 outwardly until at least a portion of the retention arms 1014 and 1016 can be received within a respective groove 1030 of the catch 1028.

When the coupling 1006 is removed from the channel 1012, the retention arms 1014 and 1016 can be urged outwardly from the channel 1012. For example, the coupling 1006 can be configured to urge the retention arms 1014 and 1016 outwardly in response to a force being applied to the coupling 1006 (e.g., a force applied to the coupling in a direction generally parallel to the longitudinal axis 821 of the vacuum pod 800).

The coupling 1006 can include a coupling body 1034 and a sleeve 1036. The sleeve 1036 can be configured to slideably engage the coupling body 1034. The sleeve 1036 can be configured to slide longitudinally along the coupling body 1034 between a retaining position and a release position. When the sleeve 1036 is urged towards the release position, the sleeve 1036 is configured to urge the retention arms 1014 and 1016 outwardly such that the coupling 1006 can disengage the receptacle 1010. For example, the sleeve 1036 can include a wedge 1038 configured to engage corresponding release bevels 1040 and 1042 defined by the retention arms 1014 and 1016. The engagement between the wedge 1038 and the release bevels 1040 and 1042 urges the retention arms 1014 and 1016 outwardly. As the retention arms 1014 and 1016 are urged outwardly, the retention arms 1014 and 1016 come out of engagement with the grooves 1030 such that the coupling 1006 can be separated from the receptacle 1010.

Figure 11:
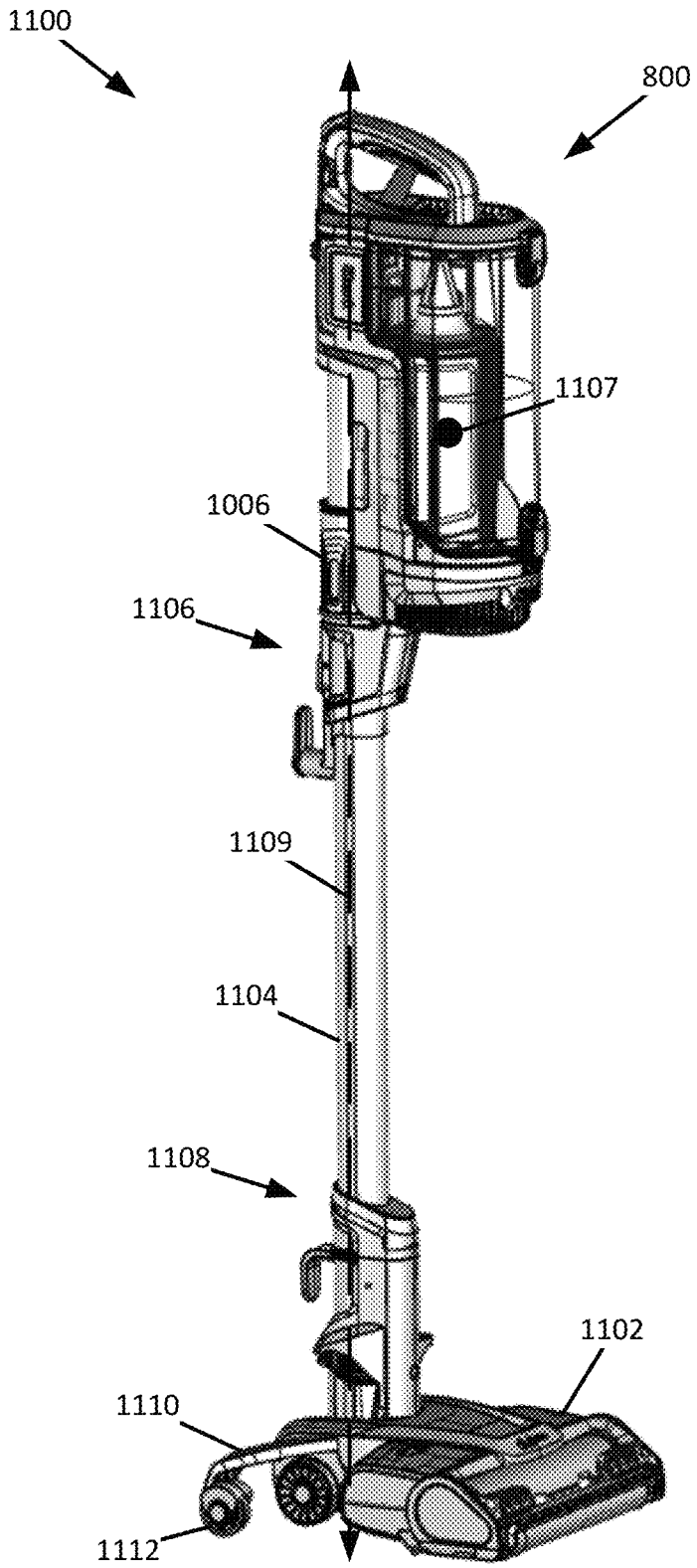
FIG. 11 shows a perspective view of an upright vacuum cleaner including the vacuum pod of FIG. 8, consistent with embodiments of the present disclosure.

FIG. 11 shows a perspective view of an upright vacuum cleaner 1100, which may be an example of the surface treatment apparatus 200 of FIG. 2. As shown, the upright vacuum cleaner 1100 includes the vacuum pod 800 which is fluidly coupled to a surface treatment head 1102 via a wand 1104. A first end 1106 of the wand 1104 is removably coupled to the coupling 1006. As such, the vacuum pod 800 may be decoupled from the wand 1104 and be used independently of the wand 1104 and the surface treatment head 1102. A second end 1108 of the wand 1104 is removably coupled to the surface treatment head 1102. As such, the wand 1104 can be decoupled from the surface treatment head 1102 such that the vacuum pod 800 and the wand 1104 can be used independently of the surface treatment head 1102.

When coupled to the wand 1104 a center of mass 1107 of the vacuum pod 800 may be positioned forward of a central longitudinal axis 1109 of the wand 1104 such that the center of mass 1107 of the vacuum pod 800 is positioned over the surface treatment head 1102. Such a configuration may increase the stability of the upright vacuum cleaner 1100. In some instances, the surface treatment head 1102 may include one or more stabilizers 1110. The stabilizers 1110 may be configured to increase the stability of the upright vacuum cleaner 1100 when in a storage position. As such, the stabilizers 1110 can be configured to transition between a retracted position and an extended position in response to the upright vacuum cleaner 1100 transitioning between an in-use and a storage position (e.g., when the wand 1104 transitions between an upright and a reclined position). In some instances, the stabilizers 1110 may include one or more stabilizer wheels 1112. The stabilizer wheels 1112 may be configured to facilitate movement of the upright vacuum cleaner 1100 when the upright vacuum cleaner 1100 is in a storage position.

Figure 12:
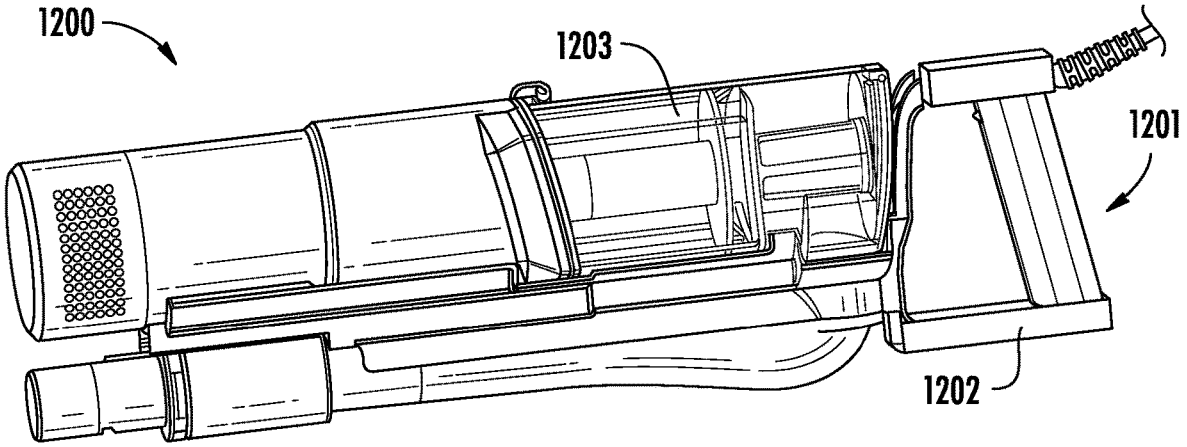
FIG. 12 shows a perspective view of a vacuum pod having a rotatable handle in a first handle position, consistent with embodiments of the present disclosure.
Figure 13:
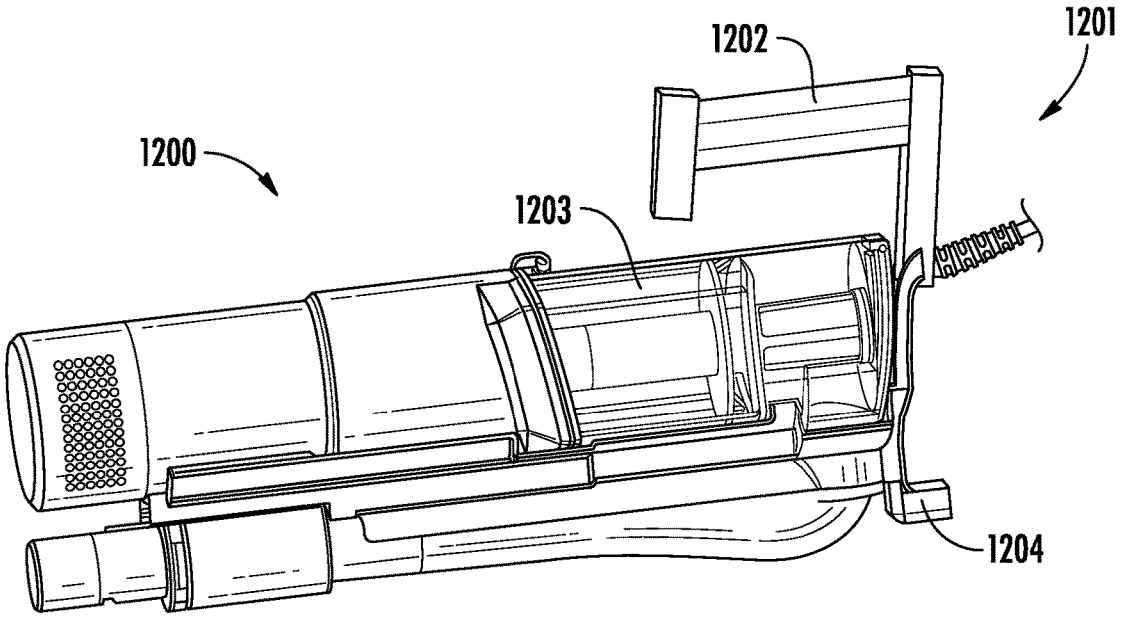
FIG. 13 shows another perspective view of the vacuum pod of FIG. 12 having the rotatable handle in a second handle position, consistent with embodiments of the present disclosure.

FIGS. 12 and 13 show perspective views of a vacuum pod 1200, which may be an example of the vacuum pod 100 of FIG. 1. As shown, the vacuum pod 1200 includes a rotatable handle 1202 positioned at a distal end 1201 of the vacuum pod 1200 proximate a dust cup 1203. The rotatable handle 1202 is configured to transition between a first handle position (FIG. 12) and a second handle position (FIG. 13). The rotatable handle 1202 can be configured to rotate in response to the actuation of a latch 1204. By configuring the rotatable handle 1202 to transition between a first and second handle position, a user may be able to adjust the position of the rotatable handle 1202 based on how the vacuum pod 1200 is being used.

Figure 14:
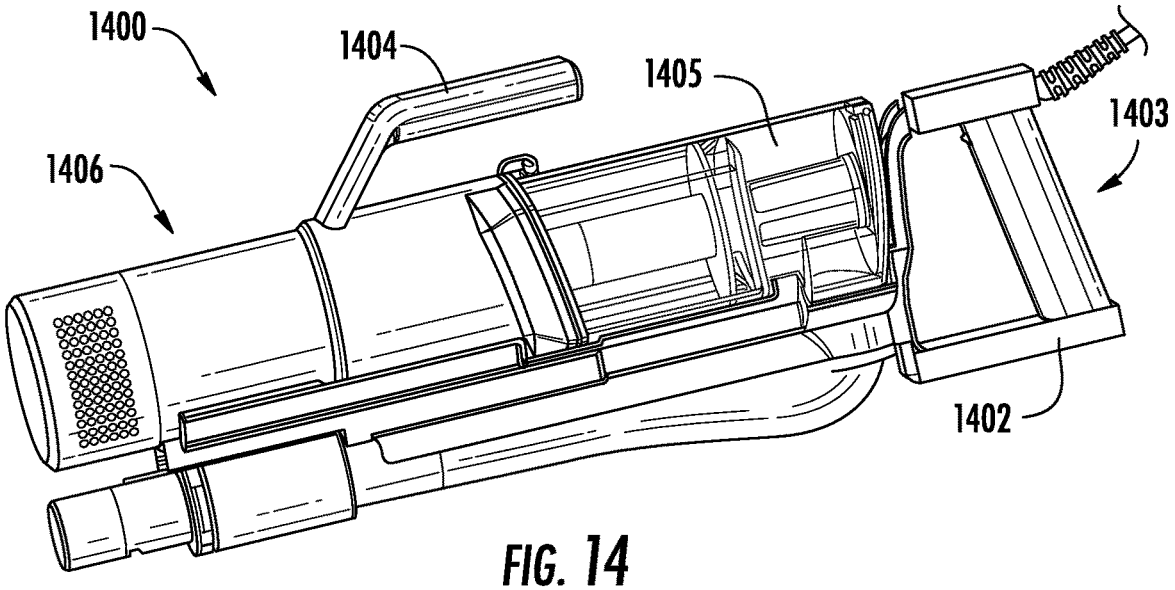
FIG. 14 shows a perspective view of a vacuum pod having a forward and rearward handle, consistent with embodiments of the present disclosure.
Figure 15:
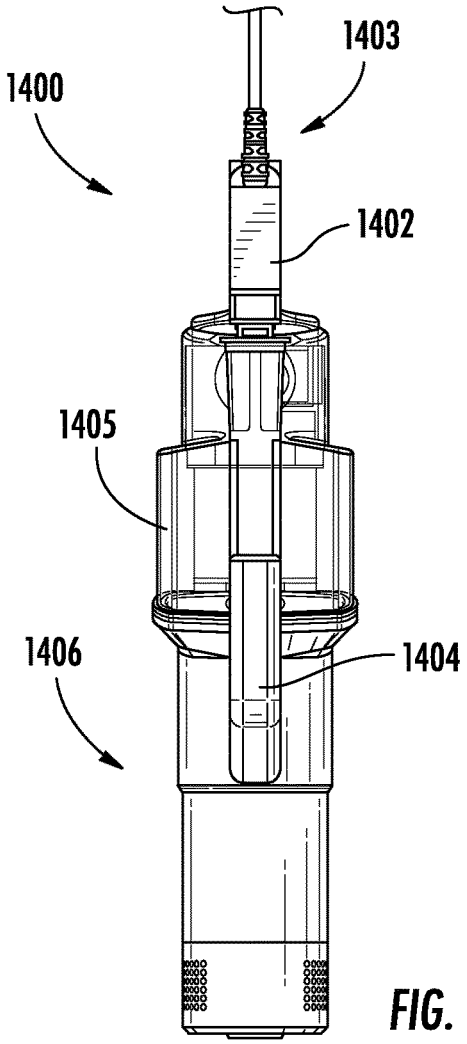
FIG. 15 shows a top view of the vacuum pod of FIG. 14, consistent with embodiments of the present disclosure.

FIGS. 14 and 15 show perspective views of a vacuum pod 1400, which may be an example of the vacuum pod 100 of FIG. 1. As shown, the vacuum pod 1400 includes a rearward handle 1402 disposed at a distal end 1403 of the vacuum pod 1400 and proximate a dust cup 1405. As also shown, the vacuum pod 1400 includes a forward handle 1404 extending from a vacuum pod body 1406 of the vacuum pod 1400. By including the rearward handle 1402 and the forward handle 1404, a user can alternate between the forward and rearward handles 1402 and 1404 based on how the vacuum pod 1400 is being used.

Figure 16:
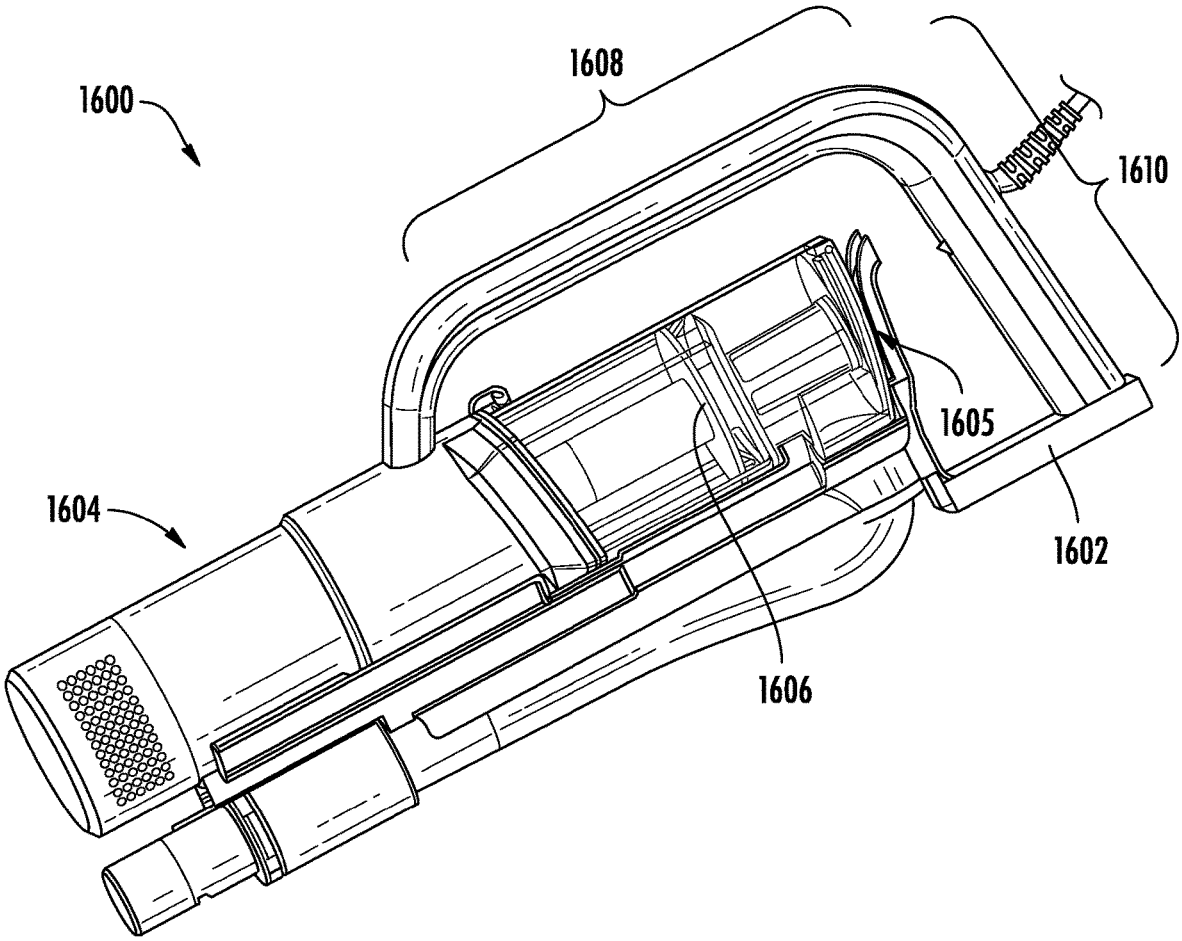
FIG. 16 shows a perspective view of a vacuum pod having a wrap-around handle, consistent with embodiments of the present disclosure.

FIG. 16 shows a perspective view of a vacuum pod 1600, which may be an example of the vacuum pod 100 of FIG. 1. As shown, the vacuum pod 1600 includes a wrap-around handle 1602 that extends along at least a portion of a vacuum pod body 1604 of the vacuum pod 1600 and over a distal end 1605 of a dust cup 1606. As such, the wrap-around handle 1602 can generally be described as having a first hand position 1608 that extends generally parallel to the vacuum pod body 1604 and a second hand position 1610 that extends generally parallel to the distal end 1605 of the dust cup 1606 (e.g., transverse to a longitudinal axis of the vacuum pod body 1604). The first and second hand positions 1608 and 1610 may allow a user to alternate a holding position of the vacuum pod 1600 based on how the vacuum pod 1600 is being used.

Figure 17:
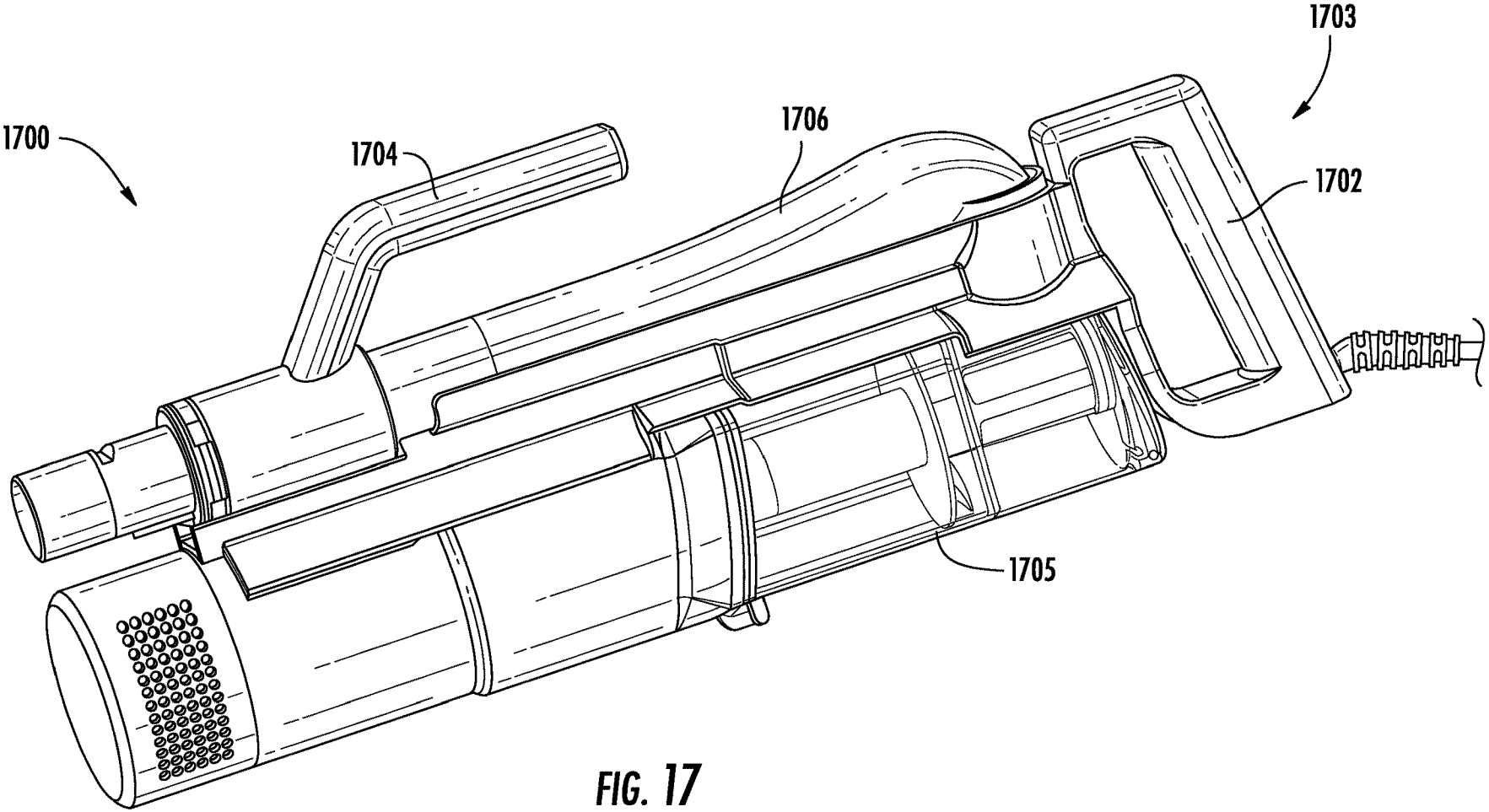
FIG. 17 shows a perspective view of a vacuum pod having a forward handle and a rearward handle, consistent with embodiments of the present disclosure.

FIG. 17 shows a perspective view of a vacuum pod 1700, which may be an example of the vacuum pod 100 of FIG. 1. As shown, the vacuum pod 1700 includes a rearward handle 1702 disposed at a distal end 1703 of the vacuum pod 1700 and proximate a dust cup 1705. As also shown, the vacuum pod 1700 includes a forward handle 1704 extending from a fluid conduit 1706 of the vacuum pod 1700. By including the rearward handle 1702 and the forward handle 1704, a user can alternate between the forward and rearward handles 1702 and 1704 based on how the vacuum pod 1700 is being used.

Figure 18:
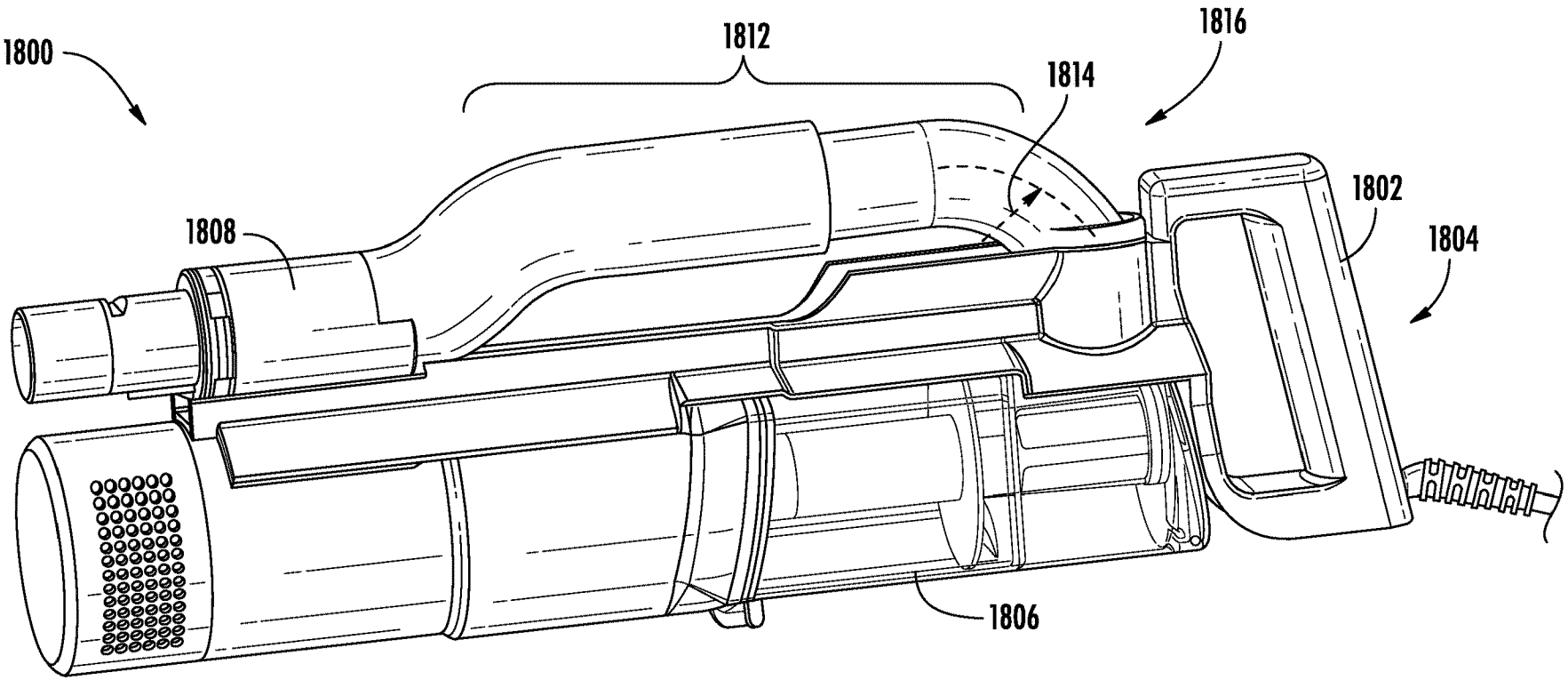
FIG. 18 shows a perspective view of a vacuum pod, wherein at least a portion of a fluid conduit defines a handle portion, consistent with embodiments of the present disclosure.

FIG. 18 shows a perspective view of a vacuum pod 1800, which may be an example of the vacuum pod 100 of FIG. 1. As shown, the vacuum pod 1800 includes a handle 1802 positioned at a distal end 1804 of the vacuum pod 1800 proximate a dust cup 1806. As shown, the vacuum pod 1800 includes a fluid conduit 1808 extending along a vacuum pod body 1810 of the vacuum pod 1800. As also shown, the fluid conduit 1808 defines a handle portion 1812. As shown, the handle portion 1812 is defined at a location along the fluid conduit 1808 where the fluid conduit 1808 extends in a direction away from the vacuum pod body 1810 for a first predetermined distance and then extends generally parallel to the vacuum pod body 1810 for a second predetermined distance before extending in a direction towards the vacuum pod body 1810. The first and second predetermined distances may be selected such that a user can grasp the fluid conduit 1808 at the handle portion 1812.

When the fluid conduit 1808 defines the handle portion 1812, a radius 1814 of a connection portion 1816 of the fluid conduit 1808 may be increased (e.g., relative to a vacuum pod not having the handle portion 1812). As shown, the connection portion 1816 is coupled to an inlet to the dust cup 1806. As such, by increasing the radius 1814 fluid flow is more gradually urged into the dust cup 1806, which may improve the performance of the vacuum pod 1800.

Figure 19:
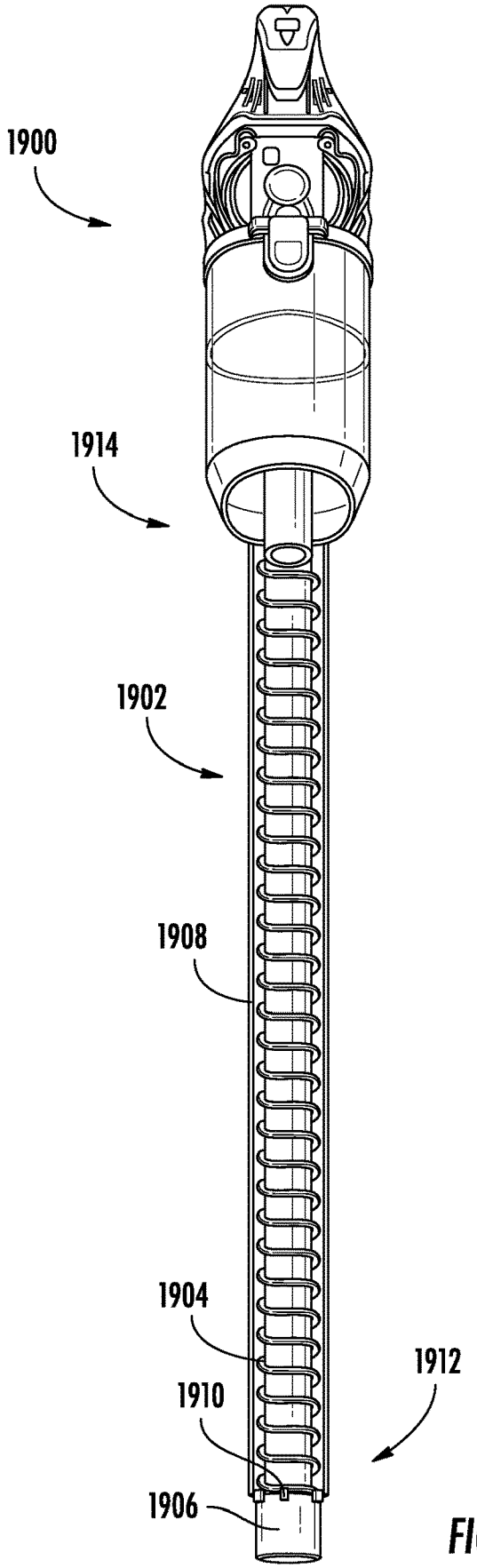
FIG. 19 shows a perspective view of a vacuum pod having an extension channel configured to receive at least a portion of a fluid conduit, consistent with embodiments of the present disclosure.

FIG. 19 shows an example of a vacuum pod 1900, which may be an example of the vacuum pod 100 of FIG. 1. As shown, the vacuum pod 1900 includes a fluid conduit 1902. The fluid conduit 1902 includes a flexible hose 1904 and a coupling 1906. As shown, when in an extended position, the flexible hose 1904 can be configured to extend within an extension channel 1908. The extension channel 1908 can be configured to maintain the flexible hose 1904 in an extended position. As such, the vacuum pod 1900 can be stored and/or used with the flexible hose 1904 in an extended position without an operator exerting a continuous force on the flexible hose 1904 to maintain the flexible hose 1904 in the extended position. For example, the extension channel 1908 can be configured to couple to the coupling 1906 using one or more catches 1910 that extend from the coupling 1906. In some instances, the coupling 1906 may also be configured such that it can be removably coupled to the vacuum pod 1900.

The extension channel 1908 can extend circumferentially around at least a portion of the flexible hose 1904. A distal end 1912 of the extension channel 1908 and/or the coupling 1906 may be configured to directly couple to one or more cleaning accessories such that the cleaning accessories are fluidly coupled to the vacuum pod 1900. A proximal end 1914 of the extension channel 1908 can be configured to be coupled to the vacuum pod 1900, wherein the proximal end 1914 of the extension channel 1908 is opposite the distal end 1912 of the extension channel 1908.

An example of a vacuum pod may include a handle, a vacuum pod body, a dust cup removably coupled to the vacuum pod body, and a fluid conduit fluidly coupled to the dust cup. The fluid conduit may include a flexible hose configured to transition between an expanded and a retracted position and a coupling configured to be removably coupled to the vacuum pod body. A first end of the flexible hose may be coupled to the vacuum pod body and a second end of the flexible hose may be coupled to the coupling. When the coupling is coupled to the vacuum pod body, the flexible hose may be in the retracted position.

In some instances, the vacuum pod body defines a suction motor cavity and at least a portion of the dust cup extends between the suction motor cavity and the handle. In some instances, the dust cup may include a cyclonic region and a debris collection region. At least a portion of the cyclonic region may be disposed between the suction motor cavity and the handle. In some instances, the debris collection region may include a protrusion configured to mitigate entrainment of debris deposited in the debris collection region in air flowing through the dust cup. In some instances, the dust cup may include an openable door and the protrusion may extend from the openable door. In some instances, the vacuum pod body may define a receptacle for receiving at least a portion of the coupling. In some instances, the receptacle may include a channel having a first and a second retention arm. The first and second retention arms may be biased into the channel. In some instances, the coupling may include a catch, wherein at least a portion of the catch is configured to be received within the channel. In some instances, the catch includes a plurality of grooves. The grooves may be configured to engage a corresponding one the first and second retention arms. In some instances, when the coupling is being coupled to the vacuum pod body, the catch may be configured to urge the first and second retention arms outwardly.

Another example of a vacuum pod may include a vacuum pod body and a dust cup removably coupled to the vacuum pod body. The dust cup may include an openable door, a debris collection region, and a protrusion extending from the openable door. The protrusion may be configured to mitigate entrainment of debris deposited in the debris collection region in air flowing through the dust cup.

In some instances, the vacuum pod may further include a fluid conduit fluidly coupled to the dust cup. The fluid conduit may include a flexible hose configured to transition between an expanded and a retracted position and a coupling configured to be removably coupled to the vacuum pod body. A first end of the flexible hose may be coupled to the vacuum pod body and a second end of the flexible hose may be coupled to the coupling. When the coupling is coupled to the vacuum pod body, the flexible hose may be in the retracted position. In some instances, the vacuum pod body defines a receptacle for receiving at least a portion of the coupling. The receptacle may include a channel having a first and a second retention arm. The first and second retention arms may be biased into the channel. In some instances, the coupling may include a catch. At least a portion of the catch may be configured to be received within the channel. In some instances, the catch may include grooves configured to engage a corresponding one the first and second retention arms. The catch may be configured to urge the first and second retention arms outwardly such that the first and second retention arms can engage the corresponding grooves.

Another example of a vacuum pod may include a handle, a dust cup, a fluid conduit, and a vacuum pod body. The fluid conduit may be fluidly coupled to the dust cup. The fluid conduit may include a flexible hose having a first end and a second end, wherein the flexible hose may be configured to transition between an expanded and a retracted position. The fluid conduit may also include a coupling that may have a catch, wherein the coupling may be coupled to the second end of the flexible hose. The vacuum pod body may be coupled to the first end of the flexible hose. The vacuum pod body may define a receptacle for receiving at least a portion of the catch. The receptacle may include a channel having a first and a second retention arm. The first and second retention arms may be configured to engage corresponding grooves defined in the catch.

In some instances, the vacuum pod body may define a suction motor cavity, wherein at least a portion of the dust cup may extend between the suction motor cavity and the handle. In some instances, the dust cup may include a cyclonic region and a debris collection region, wherein at least a portion of the cyclonic region may be disposed between the suction motor cavity and the handle. In some instances, the debris collection region may include a protrusion configured to mitigate entrainment of debris deposited in the debris collection region in air flowing through the dust cup. In some instances, the dust cup may include an openable door and the protrusion may extend from the openable door.

An example of a surface treatment apparatus may include a wand, a surface treatment head coupled to the wand, and a vacuum pod fluidly coupled to the wand. The vacuum pod may include a handle, a vacuum pod body, a dust cup removably coupled to the vacuum pod body, and a fluid conduit fluidly coupled to the dust cup. The fluid conduit may include a flexible hose configured to transition between an expanded and a retracted position and a coupling configured to be removably coupled to the vacuum pod body. A first end of the flexible hose may be coupled to the vacuum pod body and a second end of the flexible hose may be coupled to the coupling. When the coupling is coupled to the vacuum pod body, the flexible hose may be in the retracted position.

In some instances, the vacuum pod body defines a suction motor cavity and at least a portion of the dust cup extends between the suction motor cavity and the handle. In some instances, the dust cup may include a cyclonic region and a debris collection region. At least a portion of the cyclonic region may be disposed between the suction motor cavity and the handle. In some instances, the debris collection region may include a protrusion configured to mitigate entrainment of debris deposited in the debris collection region in air flowing through the dust cup. In some instances, the dust cup may include an openable door and the protrusion may extend from the openable door. In some instances, the vacuum pod body may define a receptacle for receiving at least a portion of the coupling. In some instances, the receptacle may include a channel having a first and a second retention arm. The first and second retention arms may be biased into the channel. In some instances, the coupling may include a catch, wherein at least a portion of the catch is configured to be received within the channel. In some instances, the catch includes a plurality of grooves. The grooves may be configured to engage a corresponding one the first and second retention arms. In some instances, when the coupling is being coupled to the vacuum pod body, the catch may be configured to urge the first and second retention arms outwardly.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum pod comprising:

a handle;

a vacuum pod body including a receptacle that defines a channel, wherein the channel includes first and second opposing sidewalls and first and second retention arms disposed on the first and second opposing sidewalls, respectively, wherein distal ends of the first and second sidewalls define an opening and wherein the first and second retention arms are biased inwardly into the channel along a first axis;

a dust cup removably coupled to the vacuum pod body;

a flexible hose configured to transition between an expanded and a retracted position; and a coupling configured to be removably coupled to the vacuum pod body, a first end of the flexible hose is coupled to the vacuum pod body and a second end of the flexible hose is coupled to the coupling, wherein, when the coupling is coupled to the vacuum pod body, the flexible hose is in the retracted position, the coupling including:

a coupling body secured to the second end of the flexible hose;

a catch that is configured to be at least partially received through the opening along a second axis generally perpendicular to the first axis to urge the first and second retention arms outwardly along said first axis; and a sleeve slidably coupled to the coupling body, the sleeve being configured to slidably move within the channel along a third axis to transition between a retaining position and a release position, the third axis being generally perpendicular to the first and second axes and generally parallel to longitudinal axes of the first and second sidewalls, wherein, when the coupling is coupled to the vacuum pod body and the sleeve is transitioned from the retaining position to the release position, the sleeve urges the first and second retention arms outwardly.

2. The vacuum pod of claim 1, wherein the vacuum pod body defines a suction motor cavity and at least a portion of the dust cup extends between the suction motor cavity and the handle.

3. The vacuum pod of claim 2, wherein the dust cup includes a cyclonic region and a debris collection region, wherein at least a portion of the cyclonic region is disposed between the suction motor cavity and the handle.

4. The vacuum pod of claim 1, wherein a retention hook is disposed on a distal end wall of the channel, the retention hook is biased inwardly into the channel in a direction generally parallel to a longitudinal axis of the channel, the distal end wall being opposite an open end of the channel.

5. The vacuum pod of claim 1, wherein the catch includes a plurality of grooves, each groove being configured to engage a corresponding one the first and second retention arms.

6. A vacuum pod comprising:

a dust cup;

a fluid conduit fluidly coupled to the dust cup, the fluid conduit including:

a flexible hose having a first end and a second end, the flexible hose being configured to transition between an expanded and a retracted position; and a coupling coupled to the second end of the flexible hose, the coupling including:

a coupling body secured to the second end of the flexible hose;

a catch; and a sleeve slidably coupled to the coupling body, the sleeve being configured to slidably transition between a retaining position and a release position; and a vacuum pod body coupled to the first end of the flexible hose, the vacuum pod body defining a receptacle for receiving at least a portion of the catch, the receptacle including a channel having first and second opposing sidewalls and a first and a second retention arm disposed on the first and second opposing sidewalls, respectively, wherein distal ends of the first and second sidewalls define an opening and wherein the first and second retention arms, wherein the first and second retention arms are biased inwardly into the channel along a first axis, the first and second retention arms being configured to engage corresponding grooves defined in the catch when the sleeve is at least partially received through the opening along a second axis generally perpendicular to the first axis, wherein the sleeve is configured to move within the channel along a third axis to urge the first and second retention arms outwardly to transition from the retaining position to the release position.

7. The vacuum pod of claim 6, wherein the vacuum pod body defines a suction motor cavity and at least a portion of the dust cup extends between the suction motor cavity and the handle.

8. The vacuum pod of claim 7, wherein the dust cup includes a cyclonic region and a debris collection region, wherein at least a portion of the cyclonic region is disposed between the suction motor cavity and a handle.

9. A surface treatment apparatus comprising:

a wand;

a surface treatment head coupled to the wand; and a vacuum pod fluidly coupled to the wand, the vacuum pod comprising:

a handle;

a vacuum pod body defining a receptacle that includes a channel, wherein the channel includes first and second opposing sidewalls and first and second retention arms disposed on the first and second opposing sidewalls, respectively, wherein distal ends of the first and second sidewalls define an opening and wherein the first and second retention arms are biased inwardly into the channel along a first axis;

a dust cup removably coupled to the vacuum pod body; and a fluid conduit fluidly coupled to the dust cup, the fluid conduit including a flexible hose configured to transition between an expanded and a retracted position and a coupling configured to be removably coupled to the vacuum pod body, a first end of the flexible hose is coupled to the vacuum pod body and a second end of the flexible hose is coupled to the coupling, wherein, when the coupling is coupled to the vacuum pod body, the flexible hose is in the retracted position, the coupling including:

a coupling body secured to the second end of the flexible hose;

a catch that is configured to be at least partially received through the opening along a second axis generally perpendicular to the first axis to urge the first and second retention arms outwardly along said first axis; and a sleeve slidably coupled to the coupling body, the sleeve being configured to slidably move within the channel along a third axis to transition between a retaining position and a release position, the third axis being generally perpendicular to the first and second axes and generally parallel to longitudinal axes of the first and second sidewalls, wherein, when the coupling is coupled to the vacuum pod body and the sleeve is transitioned from the retaining position to the release position, the sleeve urges the first and second retention arms outwardly.

10. The surface treatment apparatus of claim 9, wherein the vacuum pod body defines a suction motor cavity and at least a portion of the dust cup extends between the suction motor cavity and the handle.

11. The surface treatment apparatus of claim 10, wherein the dust cup includes a cyclonic region and a debris collection region, wherein at least a portion of the cyclonic region is disposed between the suction motor cavity and the handle.

12. The surface treatment apparatus of claim 9, wherein the catch includes a plurality of grooves, each groove being configured to engage a corresponding one the first and second retention arms.

13. The vacuum pod of claim 1, wherein the channel includes a distal end wall and an open end that is opposite the distal end wall.

14. The vacuum pod of claim 13, wherein the distal end wall includes a retention hook that is biased into the channel.

15. The vacuum pod of claim 14, wherein, when the coupling is urged into engagement with the receptacle, the coupling urges the retention hook in a direction outwardly from the channel.

16. The vacuum pod of claim 6, wherein the channel includes a distal end wall and an open end that is opposite the distal end wall.

17. The vacuum pod of claim 16, wherein the distal end wall includes a retention hook that is biased into the channel.

18. The vacuum pod of claim 17, wherein, when the coupling is urged into engagement with the receptacle, the coupling urges the retention hook in a direction outwardly from the channel.

19. The surface treatment apparatus of claim 9, wherein the channel includes a distal end wall and an open end that is opposite the distal end wall.

20. The surface treatment apparatus of claim 19, wherein the distal end wall includes a retention hook that is biased into the channel.

* * * * *